US005766820A

United States Patent [19]

Fukawa et al.

[11] Patent Number: 5,766,820

[45] Date of Patent: Jun. 16, 1998

[54] SILVER HALIDE PHOTOGRAPHIC LIGHT-SENSITIVE MATERIAL AND ITS DEVELOPING METHODS

[75] Inventors: Junichi Fukawa; Seiji Hidaka; Takeo Arai, all of Hino, Japan

[73] Assignee: Konica Corporation, Japan

[21] Appl. No.: 764,143

[22] Filed: Dec. 12, 1996

[30] Foreign Application Priority Data

Dec. 22, 1995 [JP] Japan ..... 7-334962

[51] Int. Cl.[6] ..... B03C 1/30; B03C 1/40

[52] U.S. Cl. ..... 430/264; 430/517; 430/522; 430/521; 430/622; 430/624; 430/626

[58] Field of Search ..... 430/264, 517, 430/522, 621, 622, 624, 626

[56] References Cited

U.S. PATENT DOCUMENTS 5,286,598 2/1994 Inoue et al. ..... 430/264
5,395,732 3/1995 Katoh et al. ..... 430/264
5,616,446 4/1997 Miuta et al. ..... 430/264
5,618,661 4/1997 Sampei ..... 430/264

*Primary Examiner*—Richard L. Schilling
*Attorney, Agent, or Firm*—Jordan B. Bierman; Bierman, Muserlian and Lucas

[57] ABSTRACT

A silver halide photographic light sensitive material is disclosed which comprises a support and provided thereon, a hydrophilic colloid layer comprising at least one silver halide emulsion layer and at least one non-light sensitive layer, the hydrophilic colloid layer being hardened with at least one hardener selected from the group consisting of a carboxyl active hardener, a vinylsulfone type hardener, an epoxy type hardener and a triazine type hardener, wherein a silver halide emulsion layer closest to the support of the silver halide emulsion layers contains a dye in the form of dispersed solid particles or a non-light sensitive layer closest to the support of the non-light sensitive hydrophilic colloid layers contains a dye in the form of dispersed solid particles, and the thickness swell percentage of the photographic component layer is 10 to 100%.

6 Claims, No Drawings

SILVER HALIDE PHOTOGRAPHIC LIGHT-SENSITIVE MATERIAL AND ITS DEVELOPING METHODS

INDUSTRIAL FIELD OF THE INVENTION

The present invention relates to a black-and-white silver halide photographic light sensitive material and its developing method, and particularly to a silver halide photographic light sensitive material for graphic arts and its developing method.

BACKGROUND OF THE INVENTION

Recently, in the field of graphic arts a silver halide photographic light sensitive material (hereinafter referred to as light sensitive material) is exposed and processed or processed after exposure, while mechanically conveyed. Sensitivity of light sensitive material becomes higher and higher year by year, but linear blackening (scratching due to pressure) is likely to occur when the light sensitive material contacts any protrusion on the conveying path in a processor. Such blackening tends to occur particularly in the light sensitive material containing a hydrazine compound as a super contrast increasing agent. The improvement has been eagerly sought in a hydrazine compound containing light sensitive material which enlarges its applications such as FM or precision printing.

A method for improving scratch resistance is known which reduces the surface frictional resistance of light sensitive material and controls stiffness of the binder in light sensitive material. However, satisfactory results have not been obtained by this method. Sandy fog, so-called black spots, occur in unexposed portions after development of the light sensitive material containing a hydrazine compound, which employing the above described super high contrast technique, and markedly occurs particularly after storage.

Recently, reduction of the developer replenisher replenishing amount has been attempted for saving of resources and environmental protection. However, the replenishing amount reduction brings about an increase of silver sludge or deterioration of developability. When light sensitive material is developed in the presence of a hydrazine compound (hereinafter referred to as hydrazine development) with the reduced replenishing amount, image contrast particularly is lowered due to deterioration of developability. This is an obstacle to reduction of the developer replenisher replenishing amount. A method of improving developability is well known which decreases the gelatin content of the light sensitive material, but this method also results in an increase of silver sludge and deterioration of film property. Further, the reduced gelatin content causes increase of black spots and deterioration of image quality in hydrazine development.

SUMMARY OF THE INVENTION

An object of the present invention is to provide a silver halide photographic light sensitive material and a processing method thereof which can be processed with a reduced replenishing amount of replenisher, does not deteriorate film property (particularly scratch resistance) and gives excellent photographic properties after storage material.

DETAILED DESCRIPTION OF THE INVENTION

The above-mentioned object of the present invention has been attained by the followings:

(1) a silver halide photographic light sensitive material comprising a support and provided thereon, a hydrophilic colloid layer comprising at least one silver halide emulsion layer, a first silver halide emulsion layer provided between a second silver halide emulsion layer and the support containing a dye in the form of dispersed solid particles and the hydrophilic colloid layer on the silver halide emulsion layer side being hardened with at least one hardener selected from the group consisting of a carboxyl active hardener, a vinylsulfone type hardener, an epoxy type hardener and a triazine type hardener, wherein the thickness swell percentage on the silver halide emulsion layer side is 10 to 100%, (2) the silver halide photographic light sensitive material of (1) above, wherein the silver halide emulsion layer and/or a layer adjacent to the silver halide emulsion layer contains a hydrazine derivative, (3) the silver halide photographic light sensitive material of (1) or (2) above, wherein the hydrophilic colloid layer contain a redox compound capable of releasing a development inhibitor in oxidation reaction, (4) the silver halide photographic light sensitive material of (1), (2) or (3) above, wherein a silver halide emulsion layer closest to the support and/or a layer adjacent to the silver halide emulsion layer contains a redox compound capable of releasing a development inhibitor in oxidation reaction, (5) the silver halide photographic light sensitive material of (1), (2), (3) or (4) above, wherein the material is developed with developer having a pH of from 9.0 to less than 11.0 to give an image having $\gamma$ of 10 or more, (6) A method of processing the silver halide photographic light sensitive material of (1), (2), (3), (4) or (5) above, wherein the light sensitive material is exposed, developed with developer, fixed with fixer, and washed in an automatic processor, the developer being replenished with developer replenisher of 75 to 250 ml/m$^2$ of light sensitive material and/or the fixer being replenished with fixer replenisher of 75 to 250 ml/m$^2$ of light sensitive material, or (7) a silver halide photographic light sensitive material comprising a support and provided thereon, a hydrophilic colloid layer comprising at least one silver halide emulsion layer and at least one non-light sensitive layer, the hydrophilic colloid layer being hardened with at least one hardener selected from the group consisting of a carboxyl active hardener, a vinylsulfone type hardener, an epoxy type hardener and a triazine type hardener, wherein a silver halide emulsion layer closest to the support of the silver halide emulsion layers contains a dye in the form of dispersed solid particles or a non-light sensitive layer closest to the support of the non-light sensitive hydrophilic colloid layers contains a dye in the form of dispersed solid particles, and the thickness swell percentage of the photographic component layer is 10 to 100%.

The present invention will be detailed below.

The hardener in the invention will be explained below.

The carboxyl active hardener used in the invention is preferably a compound represented by the following formula (A):

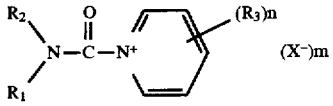

formula (A)

wherein $R_1$ and $R_2$ may be the same or different and independently represent a substituted or unsubstituted alkyl or aryl group, provided that $R_1$ and $R_2$ may combine with each other to form a heterocyclic ring; $R_2$ represents a substituent including a substituted or unsubstituted alkyl, alkoxy, acyl or acylamino group; $X^-$ represents an anion; n and m independently represent 0 or 1.

The example of the compound is shown below.

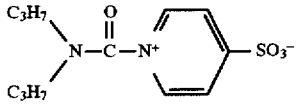

A1

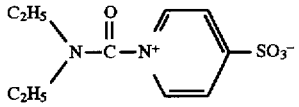

A2

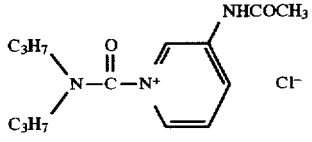

A3

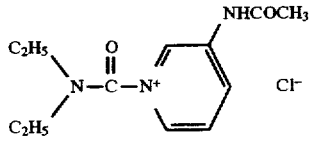

A4

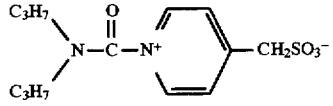

A5

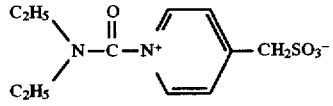

A6

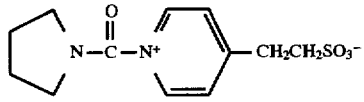

A7

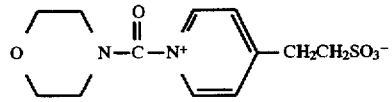

A8

-continued

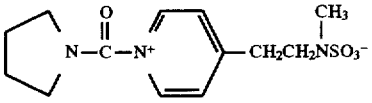

A9

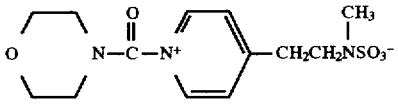

A10

Next, the active vinyl hardener used in the invention will be explained. The active vinyl hardener is a compound represented by formula, $CH_2{=}CHSO_2{-}L{-}SO_2CH{=}CH_2$ wherein L represents a divalent linkage group. The divalent linkage group includes alkylene, alkenylene, alkynylene, arylene, —O—, —NR'— in which R' represents a hydrogen atom or an alkyl group having 1 to 15 carbon atoms, —S—, —CO—, —SO—, $—SO_2—$ and $—SO_3—$. The alkylene, alkenylene, alkynylene or arylene may have further hydroxy, alkoxy, sulfamoyl, alkyl or aryl as a substituent. The example of the compound is shown below.

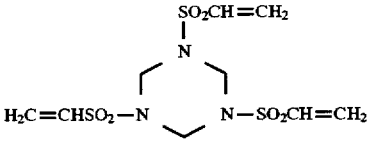

B1

$CH_2{=}CHSO_2CH_2OCH_2SO_2CH{=}CH_2$ B2

$CH_2{=}CHSO_2CH_2CH_2OCH_2CH_2SO_2CH{=}CH_2$ B3

$CH_2{=}CHSO_2(CH_2)_2SO_2CH{=}CH_2$ B4

$C(CH_2SO_2CH{=}CH_2)_4NH_2CH_2CH_2SO_3K$ B5

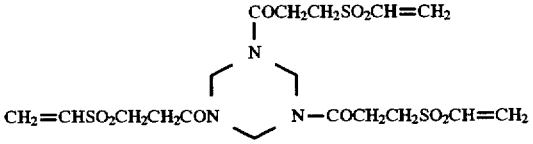

B6

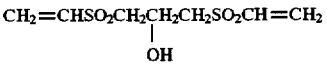

B7

$CH_2{=}CHSO_2CH_2CONHCH_2CH_2NHCOCH_2SO_2CH{=}CH_2$ B8

The epoxy compound in the invention is preferably a compound having a hydroxy group or an ether linkage. The example of the epoxy compound is shown below.

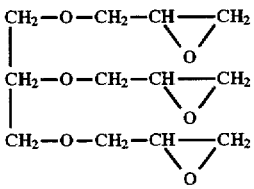

C-1

-continued

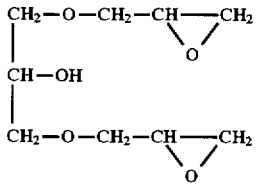

C-2

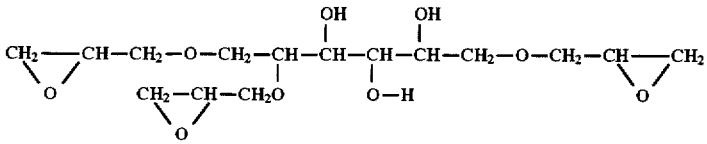

C-3

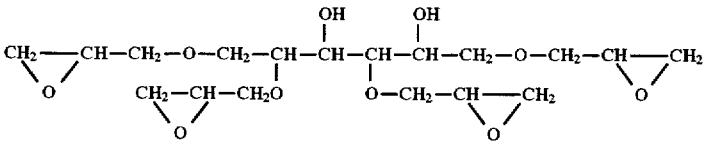

C-4

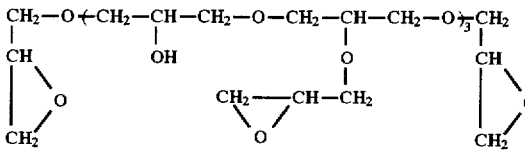

C-5

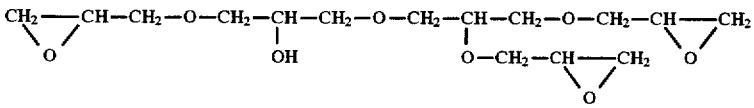

C-6

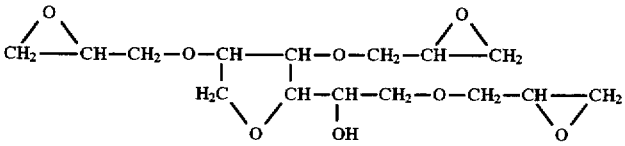

C-7

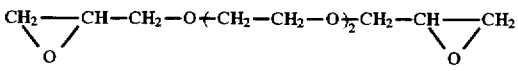

C-8

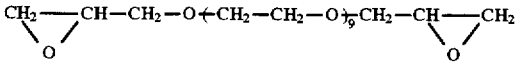

C-9

The triazine type hardener used in the invention is a compound represented by the following formula (D):

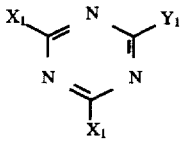

formula (D)

wherein $X_1$ represents a halogen atom, an N-methylolamine group, a glydoxy group; $Y_1$ represents a halogen atom, —OH, —OM (M represents an alkali metal atom), an amino group, a substituted amino group in which the substituent includes a phenyl, sulfophenyl, carboxyphenyl, alkyl, sulfoalkyl, carboxyalkyl, or hydroxyalkyl), an alkyl group, a phenylthioether group, a sulfonamido group or analkylsulfonamide group; and $Z_1$ is selected from the same group as denoted in $Y_1$, and may be the same as or different from $Y_1$.

The example of the compound represented by formula (D) is shown below.

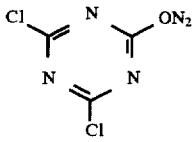

(D-1)

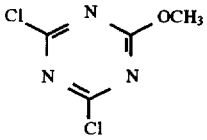

(D-2)

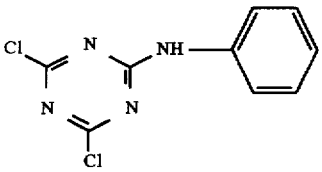

(D-3)

-continued (D-4)

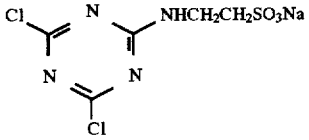

(D-5)

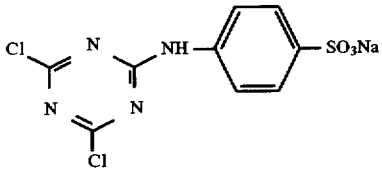

(D-6)

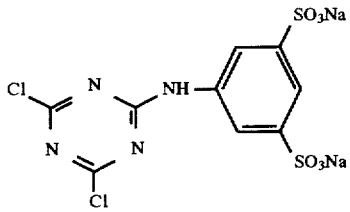

(D-7)

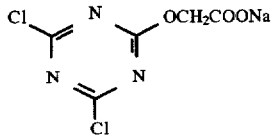

(D-8)

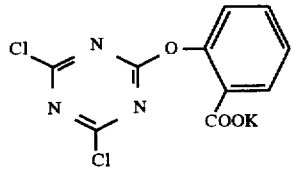

(D-9)

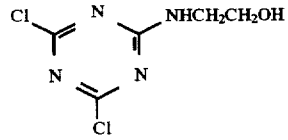

(D-10)

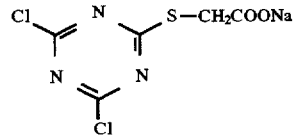

(D-11)

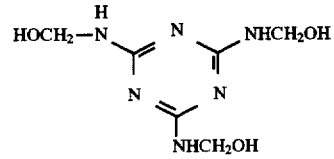

(D-12)

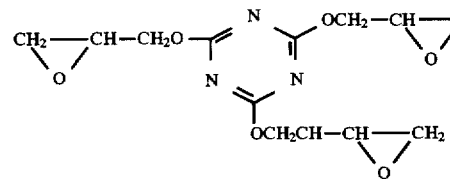

-continued (D-13)

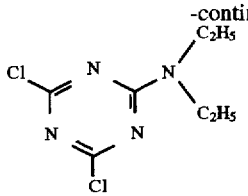

(D-14)

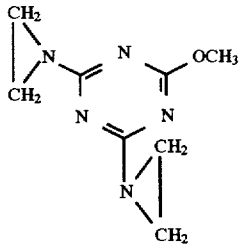

In formula (D), the compound in which $X_1$ is a halogen atom is especially preferable. $Y_1$ is selected from various groups, but is preferably —OM (M represents an alkali metal atom), or an alkylamino or arylamino group having a water-solubilizing substituent such as a carboxy group or a sulfo group.

These hardeners may be used singly or in combination, and the hardener added to a protective colloid solution in an amount of is ordinarily 0.01 to 100 weight % and preferably 0.1 to 10 weight % based on the dry weight of the protective colloid used. The dry weight of the protective colloid herein referred to means a weight after the protective colloid is dried to the constant weight at 50° C. The hardener can be added to the protective colloid solution at any step before coating of a photographic coating solution.

The dye used in the invention in the form of a solid fine particle dispersion is preferably a dye represented by the following formulae (1) through (6):

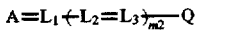

formula (1)

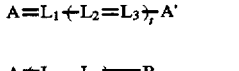

formula (2)

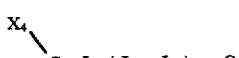

formula (3)

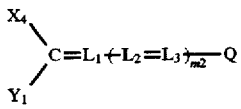

formula (4)

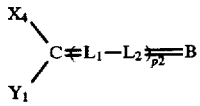

formula (5)

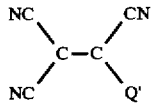

formula (6)

wherein A and A' may be the same or different and independently represent an acid nucleus; B represents a basic nucleus; Q represents an aryl group or a heterocyclic group; Q' represents a heterocyclic group; $X_4$ and $Y_1$ may be the same or different and independently represent an electron withdrawing group; $L_1$, $L_2$ and $L_3$ independently represent a methine group; $m_2$ represents 0 or 1; t represents 0, 1 or 2; and $p_2$ represents 0, 1 or 2, provided that the dye has at least one selected from the group consisting of a carboxy group, a sulfonamide group and a sulfamoyl group.

The acidic nucleus represented by A or A' in formula (1), (2) or (3) preferably is 5-pyrazolone, barbituric acid, thiobarbituric acid, rhodanine, hydantoin, thiohydantoin, oxazolone, isooxazolone, indanedione, pyrazolidinedione, oxazolidinedione, hydroxypyrrolidone or pyrazolopyrrolidine. The basic nucleus represented by B in formula (3) or (5) preferably is pyridine, quinoline, oxazole, benzoxazole, naphthoxazol, thiazole, benzthiazole, naphthothiazole, indolenine, pyrrole or indole.

The aryl group represented by Q in formula (3) or (5) includes phenyl or naphthyl. The heterocyclic group represented by Q or Q' in formula (1), (4) or (6) includes pyridyl, quinolyl, isoquinolyl, pyrrolyl, pyrazolyl, imidazolyl, indolyl, furyl and thienyl. The aryl or heterocyclic group include those having a substituent, and the substituent includes alkyl, cycloalkyl, aryl, a halogen atom, alkoxycarbonyl, aryloxycarbonyl, carboxy, cyano, hydroxy, mercapto, amino, alkoxy, aryloxy, acyl, carbamoyl, acylamino, ureido, sulfamoyl and sulfonamido. The aryl or heterocyclic group may have two or more of the above substituents. The preferable substituent is an alkyl group having 1 to 8 carbon atoms (for example, methyl, ethyl, t-butyl, octyl, 2-hydroxyethyl or 2-methoxyethyl), a hydroxy group, a cyano group, a halogen atom (for example, fluorine or chlorine), an alkoxy group having 1 to 6 carbon atoms (for example, methoxy, ethyoxy, 2-hydroxyethoxy, methylenedioxy or butoxy), a substituted amino group (for example, dimetylamino, dietylamino, di(n-butyl)amino, N-ethyl-N-hydroxyethylamino, N-ethyl-N-methanesulfonamidoethylamino, morpholino, piperidino or pyrrolidino), a carboxy group, a sulfonamido group (for example, methanesulfonamido or benzenesulfonamido) or a sulfamoyl group (for example, methylsulfamoyl or phenylsulfamoyl). The substituents may be used in combination.

The electron withdrawing group represented by $X_4$ and $Y_1$ a in formula (4) or (5) may be the same or different and is preferably a group having a Hammett σp value of 0.3 or more. Description of "Kagaku no Ryoiki", extra edition 122, 96–103 (1979), published by Nankoudo is referred to the Hammett σp value in the invention. The electron withdrawing group includes cyano, alkoxycarbonyl (for example, methoxycarbonyl, ethoxycarbonyl, butoxycarbonyl or octyloxycarbonylmethyl), aryloxycarbonyl (for example, phenoxycarbonyl, 4-hydroxyphenoxycarbonyl), carbamoyl (for example, carbamoyl, dimethylcarbamoyl, phenylcarbamoyl or 4-carboxyphenylcarbamoyl), acyl (for example, methylcarbonyl, ethylcarbonyl, butylcarbonyl, phenylcarbonyl or 4-ethysulfonamidocarbonyl), alkylsulfonyl (for example, methylsulfonyl, ethylsulfonyl, butylsulfonyl or octylsulfonyl) and arylsulfonyl (for example, phenylsulfonyl or 4-chlorophenylsulfonyl).

The methine group represented by $L_1$, $L_2$ or $L_3$ in formulae (1) through (5) includes those having a substituent, and the substituent is an alkyl group having 1 to 6 carbon atoms (for example, methyl, ethyl or hexyl), an aryl group (for example, phenyl, tolyl or 4-hydroxyphenyl), an aralkyl group (for example, benzyl or phenetyl), a heterocycic group (for example, pirydyl, furyl or thienyl), a substituted amino group (for example, dimethylamino, diethylamino or anilino), an alkylthio group (for example, methylthio).

Of dyes represented by formulae (1) through (5), a dye having a carboxy group is preferable, a dye represented by formula (1) is more preferable, and a dye represented by formula (1) in which Q is furyl is still more preferable.

The typical example of the dye in the invention is listed below, but is not limited thereto.

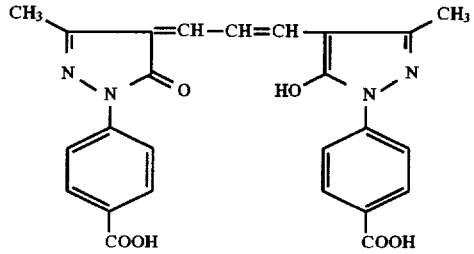

AD-1

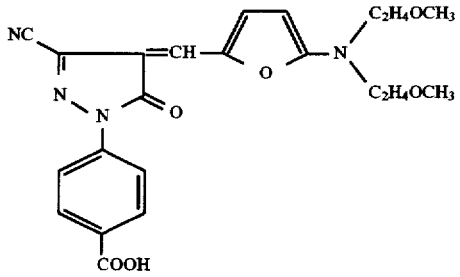

AD-2

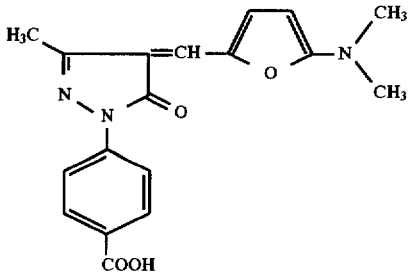

AD-3

-continued
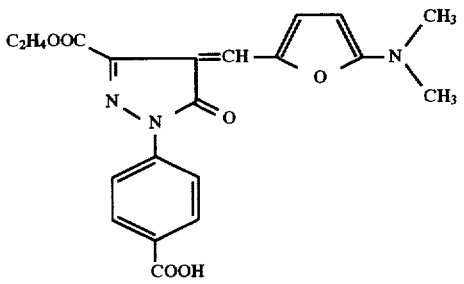
AD-4
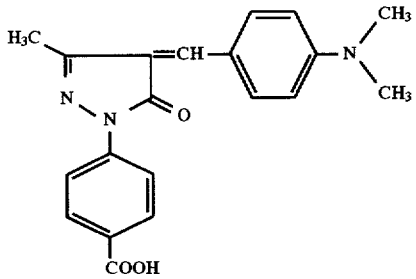
AD-5
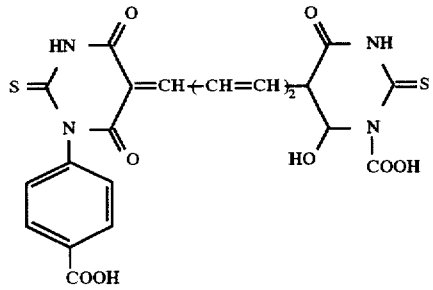
AD-6
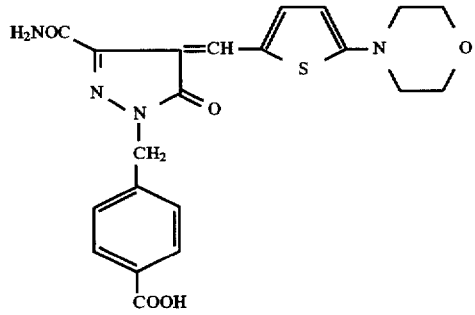
AD-7
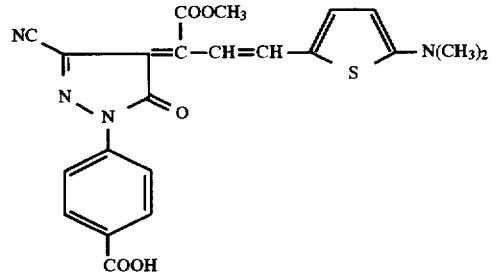
AD-8
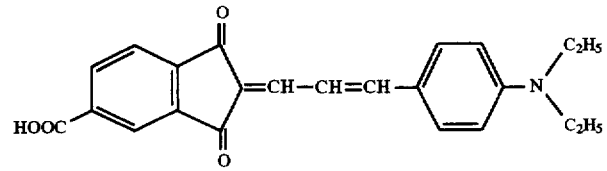
AD-9

-continued
AD-10
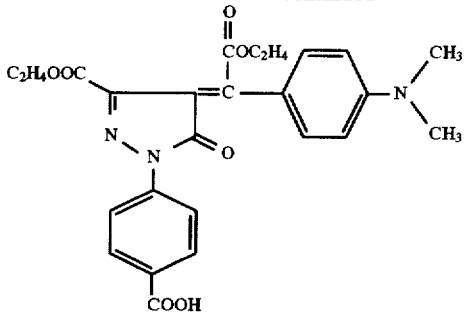
AD-11
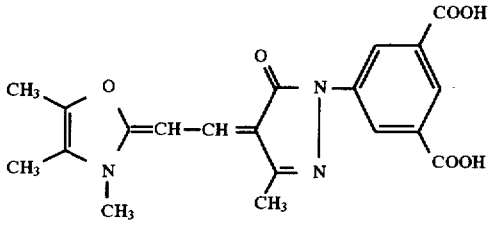
AD-12
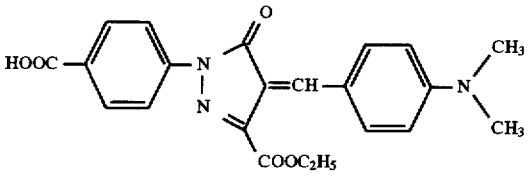
AD-13
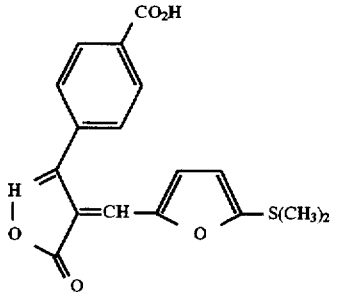
AD-14
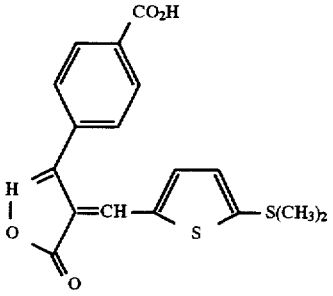
AD-15
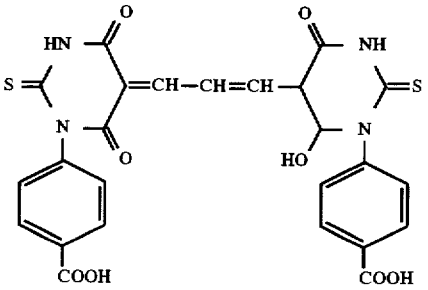

Besides the above examples, the dyes represented by formulae (1) through (6) include compounds Nos. I-1 through I-30, II-1 through II-12, III-1 through III-8, IV-1 through IV-9, V-1 through V-8, and VI-1 through VI-5 disclosed on pages 19 to 32 of Japanese Patent O.P.I. Publication No. 7-128793, but the dyes are not limited thereto.

A method of preparing a dye in the form of solid fine particle dispersion is disclosed in Japanese Patent O.P.I. Publication Nos. 52-92716/1977, 55-155350/1980, 55-155351/1980, 63-197943/1988, and 3-182743/1991, and WO-8804794. The dispersion can be prepared with a disperser such as a ball mill, a planet mill, a sand mill, a roller mill, a jet mill or a disc impeller mill. When a compound to be dispersed in the solid form is insoluble in a relatively low pH water and soluble in a relatively high pH water, the fine particle solid dispersion of the compound is obtained by dissolving the compound in a weak alkaline solution and then acidifying it to obtain precipitates or by mixing an alkaline solution containing it with an acid solution adjusting the pH to obtain precipitates. The solid fine particle dispersion may be used singly or in combination of two or more kinds. When two or more kinds of compounds are used, they may be mixed after independently dispersed or dispersed in admixture.

When the solid fine particle dispersion is prepared in an aqueous dispersion medium, the surfactant is preferably added to the dispersion during or after dispersion. The surfactant includes an anionic surfactant, a nonionic surfactant, a cationic surfactant and an amphoteric surfactant. The surfactant is preferably anionic surfactants such as alkyl sulfonates, alkylbenzene sulfonates, alkylnaphthalene sulfonates, alkyl sulfates, sulfosuccinates, sulfoalkylpolyoxyethylenealkyl phenyl ethers or N-acyl-N-alkyltaurins or nonionic surfactants such as saponin, alkyleneoxide derivatives or alkyl esters of saccharides. The especially preferable surfactant is the anionic surfactants described above. The examples of the surfactant include compounds 1 through 32 disclosed on pages 32 to 46 of Japanese Patent O.P.I. Publication No. 7-128793.

The anionic or cationic surfactant content of the dye dispersion is 0.1 to 2000 mg, preferably 0.5 to 1000 mg, based on the 1 g of the dye in the dispersion, although it is different due to kinds of surfactants or dispersion conditions of dyes.

The dye content of the dye dispersion is preferably 0.01 to 50 weight %, and more preferably 0.1 to 30 weight %. The surfactant is more preferably added to the dispersion before dispersion, and may be optionally added after dispersion. The anionic or cationic surfactant may be used singly or in combination.

The fine particles in the dye dispersion have an average particle size of preferably 0.01 to 5 μm, more preferably 0.01 to 1 μm, and still more preferably 0.01 to 0.5 μm. The particle size variation of the size distribution is preferably 50% or less, more preferably 40% or less, and still more preferably 30% or less. The particle size variation is represented by the following formula:

(Standard deviation of the particle size)×100/(the average particle size)

A hydrophilic colloid, which is used as a binder of a photographic structural layer can be added to the solid fine particle dispersion. As the hydrophilic colloid gelatin is preferable, but gelatin derivatives such as phenylcarbamylated gelatin, acylated gelatin and phthalated gelatin, gelatin grafted with an ethylenically unsaturated monomer, cellulose derivatives such as carboxymethylcellulose, hydroxymethylcellulose and cellulose sulfate, synthetic hydrophilic polymers such as polyvinyl alcohol, partially saponified polyvinyl acetate, polyacrylamide, poly-N, N-dimethylacryl amide, poly-N-vinylpyrrolidone and polymethacrylic acid or agar, gum arabic, alginic acid, albumin and casein can be also used. These may be used in combination of two or more kinds. The hydrophilic colloid content of the solid fine particle dispersion is preferably 0.1 to 12%, more preferably 0.5 to 8%.

The solid fine particle dispersion can be added to a silver halide emulsion layer or a non-light sensitive layer such as a layer on the emulsion layer, a layer beneath the emulsion layer, a protective layer, a subbing layer or a backing layer. The solid fine particle dispersion is preferably added to a layer between a support and a silver halide emulsion layer or a layer on the support opposite the emulsion layer in order to minimize halation. The solid fine particle dispersion is also preferably added to a layer on the emulsion layer in order to increase safelight safety.

The amount used of dyes dispersed in solid fine particles is preferably 1 mg to 1 g, more preferably 5 to 800 mg and still more preferably 10 to 500 mg per $m^2$ of light sensitive material, although it is different due to kinds of dyes or characteristics of the light sensitive material.

The light sensitive material used in the invention comprises a layer containing a dye in the form of solid dispersed in binder between the support and the light sensitive emulsion layer but may also comprise another light sensitive or non-light sensitive emulsion layer, or another non emulsion layer (including a hydrophilic layer or a hydrophobic polymer layer) containing a dye in the form of solid dispersed in binder. The dye in the form of solid dispersed in binder can be contained in any layer on the support opposite the emulsion layer. The water soluble dye may be contained in any layer. The dye content in the form of solid dispersed in binder is added to obtain an optical density of preferably 0.001 to 2.0, more preferably 0.005 to 1.5 when measured with at least a part of the wavelength region of light used in exposure. A dye having another absorption spectrum can be also used in any layer.

The light sensitive material of the invention is effectively used in light sensitive material for a laser. The laser includes an Ar laser, a He—Ne laser, a red laser diode, an infrared semiconductor laser and a red LED laser, but besides the above, a blue laser such as He—Cd laser can be also used. The light sensitive material of the invention is effected in light sensitive material for photographing or contact exposure.

The thickness swell percentage referred to in the invention is obtained according to the following:

The photographic component layer thickness of silver halide photographic light sensitive material is measured at 25° C. and 55% RH. A drop of 25° C. distilled water is put on the photographic component layer surface of the light sensitive material and allowed to stand for 3 minutes at 25° C. and 55% RH to obtain a swollen layer, after which the increased layer thickness increment is measured. The thickness is measured by an electron micrometer K-306 produced by Anritu Denki Co., Ltd. The thickness swell percentage is represented by the following formula:

(the increased thickness increment)×100/(the photographic component layer thickness before swelling)

The thickness swell percentage in the invention is 10 to 100%, preferably 20 to 70%, and more preferably 20 to 50%.

The hydrazine compound used in the present invention is preferably a compound represented by the following general formula (H):

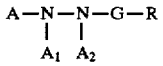

Formula (H)

In the formula, A represents an aryl group or a heterocycle containing therein a sulfur atom or oxygen atom; G represents a $-(CO)_n-$ group in which n is 1 or 2, a sulfonyl group, a sulfoxy group, an iminomethylene group, or a $-P(=O)R_2$ in which $R_2$ represents an alkyl group, an alkenyl group, an alkynyl group, an aryl group, an alkoxy group, an alkenyloxy group, an alkynyloxy group, an aryloxy group or an amino group, provided that each may be substituted; $A_1$ or $A_2$ both represent hydrogen atoms, or one of $A_1$ and $A_2$ represents a hydrogen atom and the other represents a substituted or unsubstituted alkylsulfonyl group or a substituted or unsubstituted acyl group; and R represents a hydrogen atom or an alkyl group, an alkenyl group, an aryl group, an alkoxy group, an alkenyloxy group, an aryloxy group, a heterocyclic oxy group, an amino group, a carbamoyl group or an oxycarbonyl group, each of which may be substituted.

Of the compounds represented by formula (H), the compound represented by the following formula (Ha) is particularly preferable.

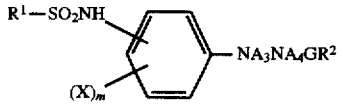

General Formula (Ha)

In the formula, $R^1$ represents an aliphatic group, for example, octyl or decyl; an aromatic group, for example, phenyl, 2-hydroxylphenyl or chlorophenyl; or a heterocyclic group, for example, pyridyl, thienyl, furyl; and these groups may be substituted by an appropriate substituent. Further, it is also preferable that $R^1$ contains at least one ballast group or a silver halide adsorption-accelerating group.

As a diffusion-proof group, a ballast groups which are commonly used in the immobile photographic additives such as couplers are preferable, and for such ballast groups, for example, an alkyl group, an alkenyl group, an alkynyl group, an alkoxy group, a phenyl group, a phenoxy group, an alkylphenoxy group, etc., which are relatively photographically inert, are cited.

The silver halide adsorption-accelerating agent includes, for example, a thiourea group, a thiourethane group, a mercapto group, a thioether group, a thione group, a heterocyclic group, a thioamide heterocyclic group, mercapto heterocyclic group, or those adsorption groups disclosed in Japanese Patent O.P.I. Publication No.64-90439/1989.

In the general formula (Ha), X represents a substituent on a phenyl group, m represents an integer of zero through four, provided when m is two or more, X may be the same or different.

In the formula (Ha), $A_3$ and $A_4$ independently have the same definition as $A_1$ and A2, respectively.

In the formula (Ha), G represents a carbonyl group, a sulfonyl group, a sulfoxy group, a phosphoryl group or an iminomethylene group, and carbonyl group is preferable as G.

In the formula (Ha), $R^2$ represents a hydrogen atom, an alkyl group, an alkenyl group, an alkynyl group, an aryl group, a heterocyclic group, an alkoxy group, a hydroxy group, an amino group or an oxycarbonyl group, and the preferable $R^2$ is $-COOR_3$ or $-CON(R^4)(R^5)$ in which $R^3$ represents an alkinyl group or a saturated heterocyclic group, $R^4$ represents a hydrogen atrom, an alkyl group, an alkenyl group, an alkynyl group, an aryl group or a heterocyclic group and $R^5$ represents an alkenyl group, an alkynyl group, a saturated heterocyclic group,a hydroxy group or an alkoxy group.

Specific examples of the compound represented by the general formula (H) are given below, however, the scope of the present invention is limited by these.

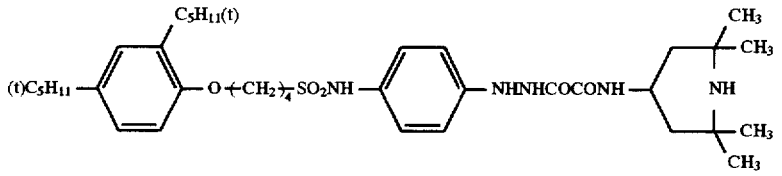

H-1

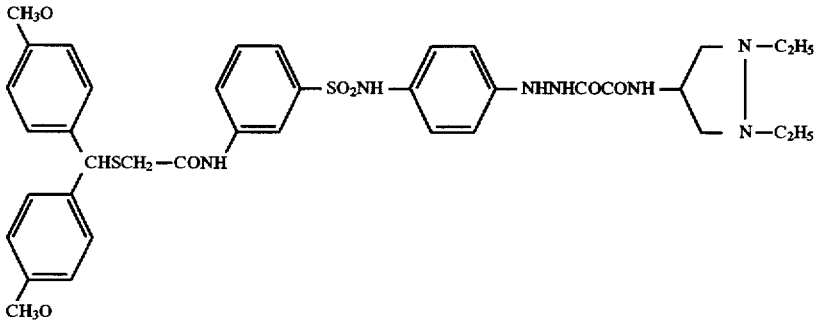

H-2

-continued
H-3
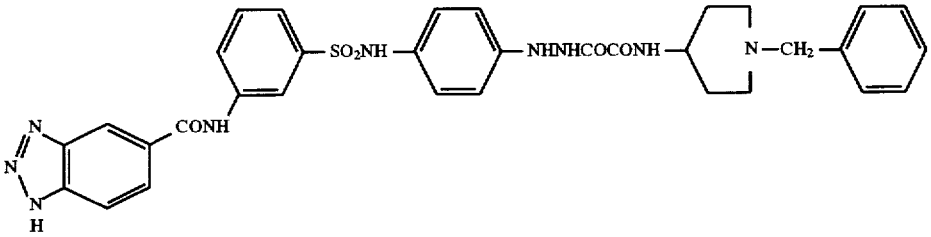
H-4
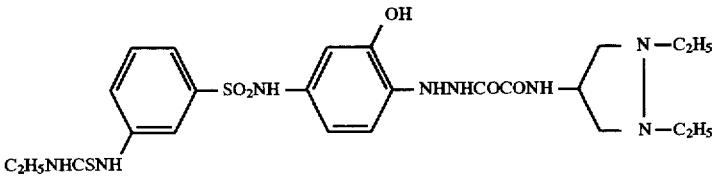
H-5
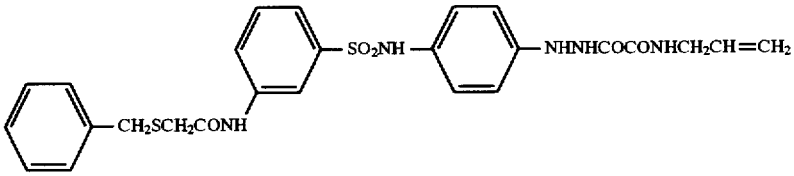
H-6
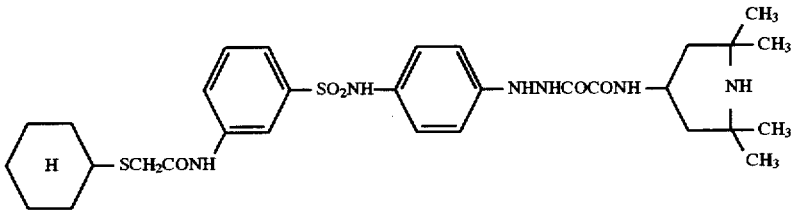
H-7
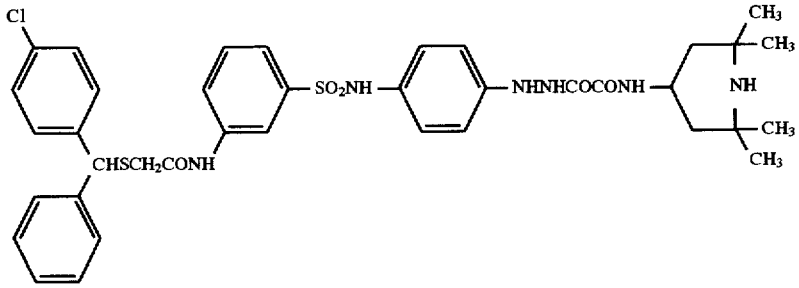
H-8
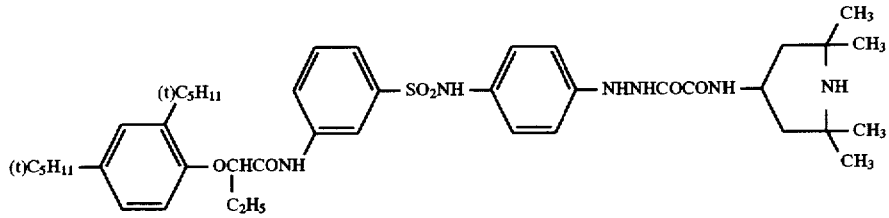
H-9
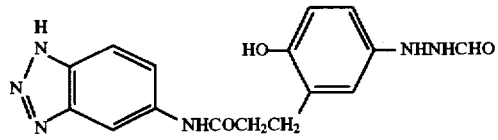
H-10
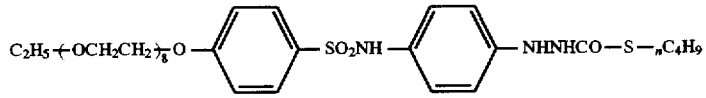

-continued
H-11
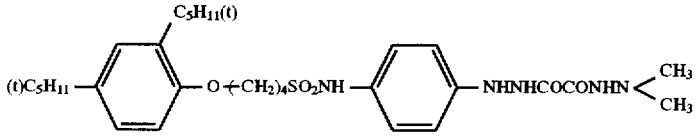
H-12
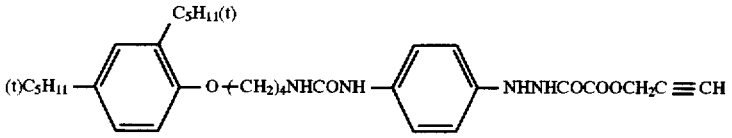
H-13
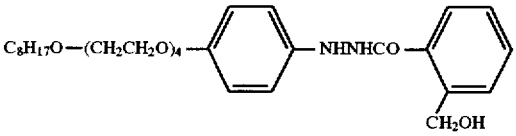
H-14
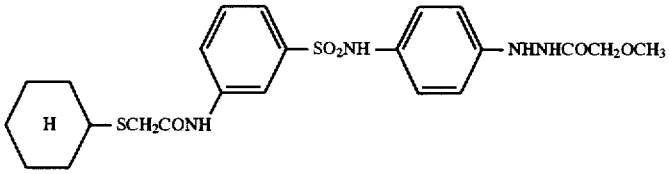
H-15
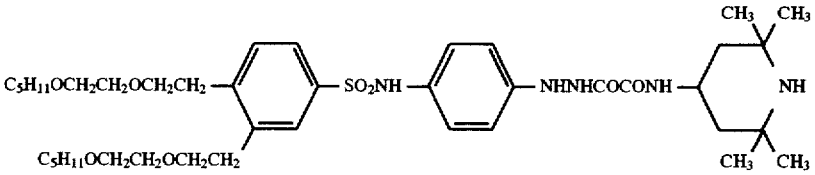
H-16
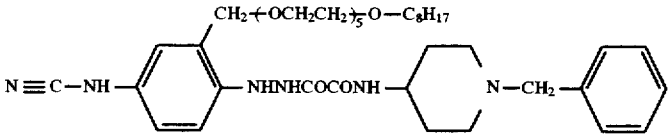
H-17
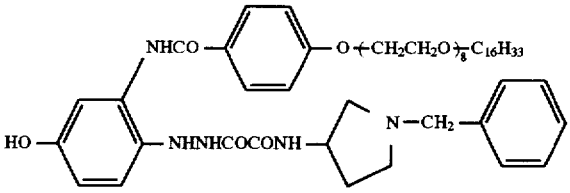
H-18
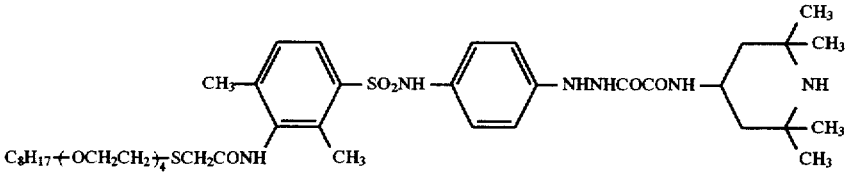
H-19
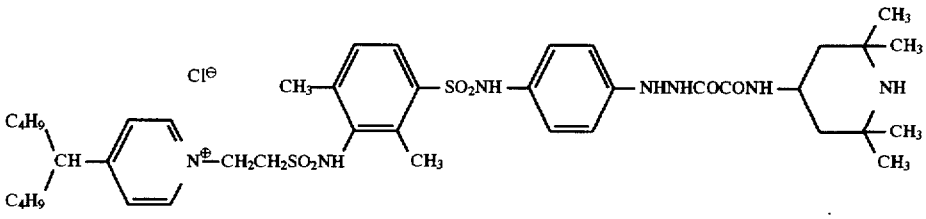

-continued
H-20
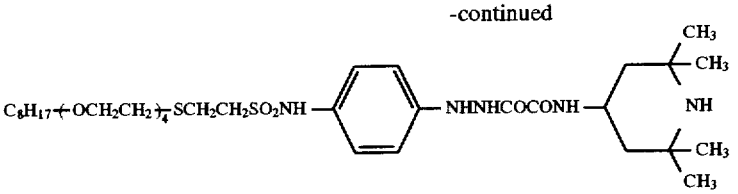
H-21
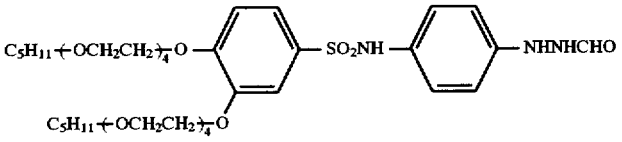
H-22
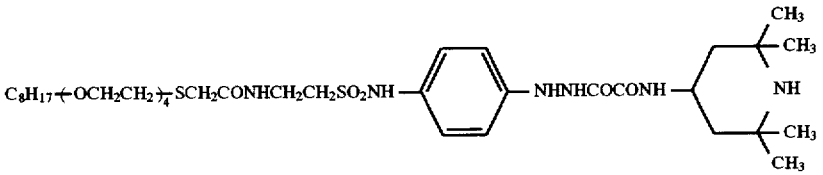
H-23
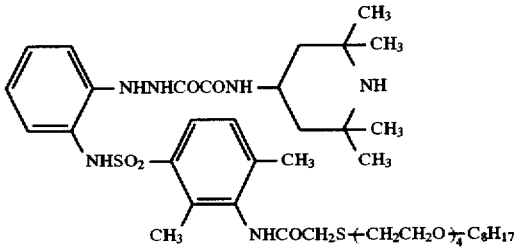
H-24
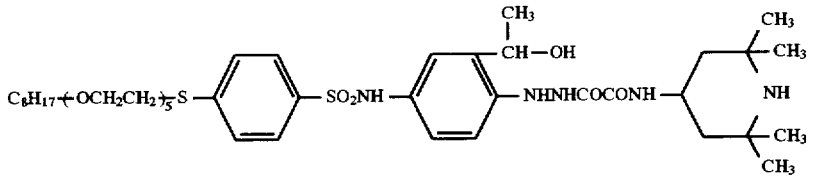
H-25
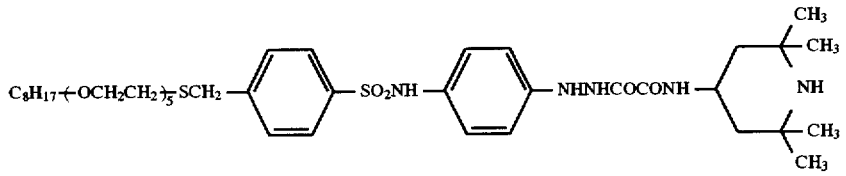
H-26
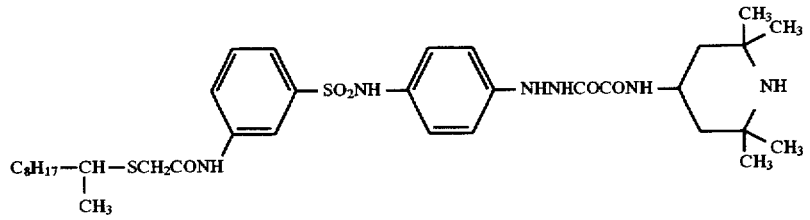
H-27
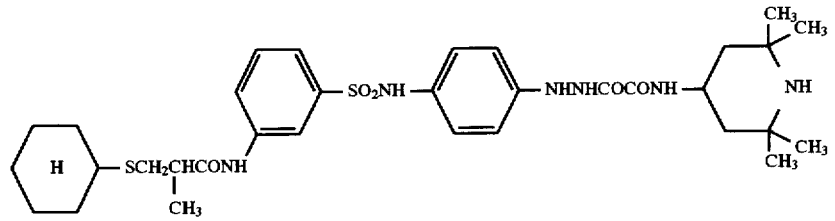
In addition, as examples of preferred hydrazine derivatives, for example,exemplified Compounds (1) through (252) disclosed on columns 59 through 80 of U.S. Pat. No. 5,229,248 can be mentioned.

The hydrazine derivatives used in the present invention can be synthesized according to the conventionally known methods in the art. For example, they may be synthesized according to the method disclosed on columns 59 through 80 in the U.S. Pat. No. 5,229,248.

The hydrazine compound used in the invention is added to a silver halide emulsion layer and/or its adjacent layer. The hydrazine compound used in the invention can be added to any layer on the silver halide emulsion layer side, and is preferably added to a silver halide emulsion layer or its adjacent layer. Although the optimum addition amount of the hydrazine compound may be varied depending on the size, halide composition, degree of chemical ripening of silver halide grains and kind of restraining agent used, however, it is generally between $10^{-6}$ and $10^{-1}$ mol, and, more preferably, between $10^{-5}$and $10^{-2}$ mol per one mol of silver halide.

In order to accelerate effectively the contrast-increase by the hydrazine compound, it is preferable to use a nucleation accelerating compound represented by the following general formula (Na) or (Nb).

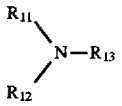

General Formula (Na)

-continued

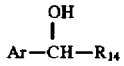

General Formula (Nb)

In the Formula (Na), R11, R12 and R13 independently represent a hydrogen atom, an alkyl group,a substituted alkyl group, an alkenyl group, a substituted alkenyl group, an alkinyl group, an aryl group or a substituted aryl group, provided that $R_{11}$, $R_{12}$ and $R_{13}$ can combine with each other to form a ring. Among the compounds represented by formula (na) is preferable an aliphatic tertiary amine compound. It is preferable for these compounds to contain in their molecules a diffusion-proof group or a silver halide-adsorbing group. In order to be non-diffusible, the compound has preferably a molecular weight of 100 or more and, more preferably, not less than 300. As a preferable adsorbing group, for example, a heterocyclic group, a mercapto group, a thioether group, a thion group, thiourea group, etc. can be mentioned. As particularly preferable compound represented by the general formula (Na), a compound having in its molecule at least one thioether group as the silver halide adsorbing group can be mentioned.

Below, specific nucleation accelerating compounds represented by the General Formula (Na) are given.

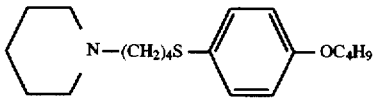

Na-1

$[(C_3H_7)_2N(CH_2)_3OCH_2CH_2]_2S$

Na-2

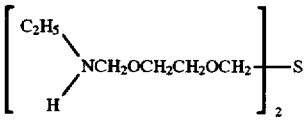

Na-3

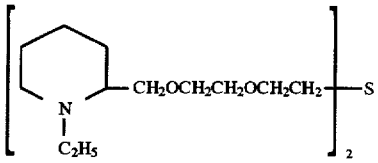

Na-4

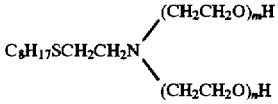

m + n = 20

Na-5

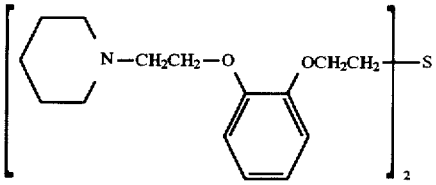

Na-6

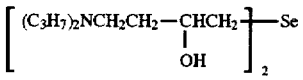

Na-7

-continued

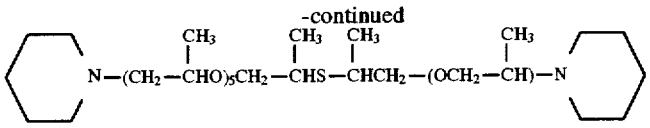

Na-8

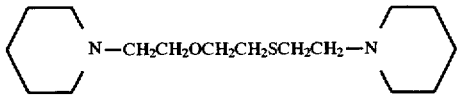

Na-9

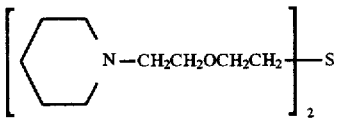

Na-10

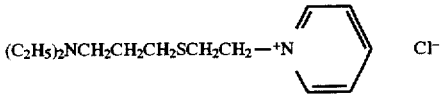

Na-11

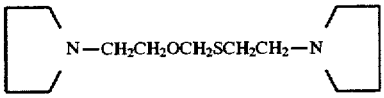

Na-12

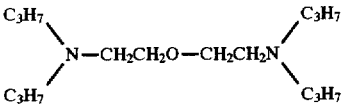

Na-13

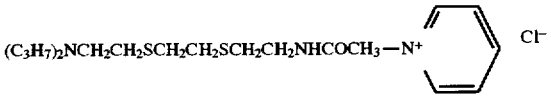

Na-14

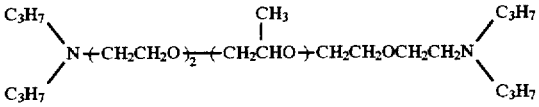

Na-15

Na-16

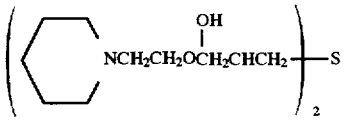

Na-17

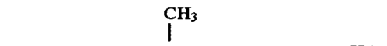

Na-18

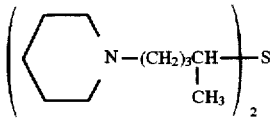

Na-19

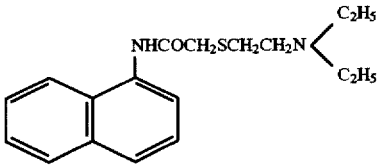

Na-20

In the general Formula (Nb), Ar represents a substituted or unsubstituted aromatic hydrocarbon group or a heterocyclic group. $R_{14}$ represents a hydrogen atom, an alkyl group, an alkenyl group, an alkynyl group, or an aryl group, provided that Ar and $R_{14}$ may form a ring through a connecting group. The compound preferably contain in its molecule an diffusion-proof group or a silver halide-adsorbing group. The molecular weight to confer diffusion-proof property on the compound is 120 or more, and, more preferably, 300 or more. Further, as preferable silver halide-adsorbing group, the same group defined as the silver halide-adsorbing group in Formula (H) can be mentioned.

Specific exemplified compounds represented by Formula (Nb) are given below.

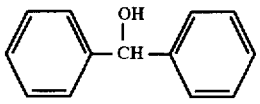

Nb-1

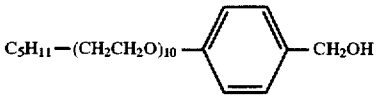

Nb-2

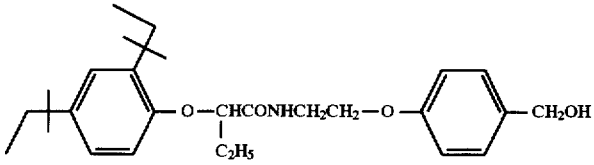

Nb-3

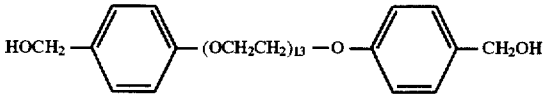

Nb-4

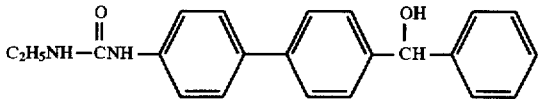

Nb-5

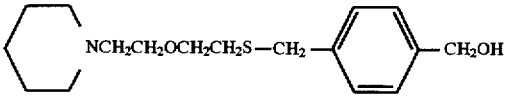

Nb-6

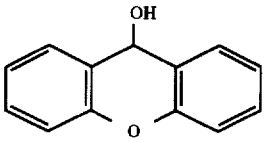

Nb-7

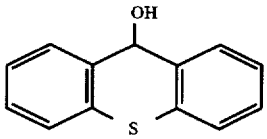

Nb-8

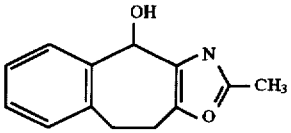

Nb-9

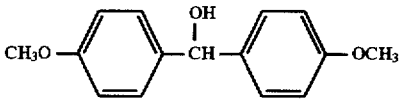

Nb-10

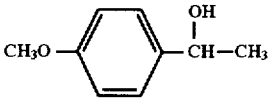

Nb-11

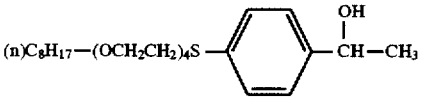

Nb-12

In addition, specific examples of the nucleation accelerating compounds include exemplified Compounds (2-1) through (2-20) disclosed in paragraphs (0062) on Page 13 through (0065) on page 15 in Japanese Patent OPI Publication No.6-258751(1994) and exemplified Compounds 3-1 to 3-6 disclosed in Japanese Patent OPI Publication No.6-258751 (1994).

The nucleation accelerating compound may be used in any layer located on the side of the silver halide emulsion layer. Preferably the compounds are incorporated either in the silver halide emulsion layer or a layer adjacent thereto. Although the optimum addition amount of the compound may be varied depending on the size, halide composition, degree of chemical ripening of silver halide grains and kind of restraining agent used, however, it is generally between $10^{-6}$ and $10^{-1}$ mol, and, more preferably, between $10^{-5}$ and $10^{-2}$ mol per one mol of silver halide. In order to enhance the effect of the invention, a redox compound capable of releasing a development restraining agent on oxidation reaction is preferably used in combination.

The redox compound capable of releasing a development restraining agent on oxidation reaction will be explained below.

The redox compound has, as a redox group, hydroquinones, catechols, naphthohydroquinones, aminophenols, pyrazolidones, hydrazines, reductones, or x-aminoketones. The preferable compound is a compound having, as a redox group, a —NHNH— group or a compound represented by the following formula (7), (8), (9), (10), (11) or (12):

formula (7)

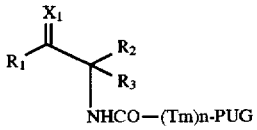

formula (8)

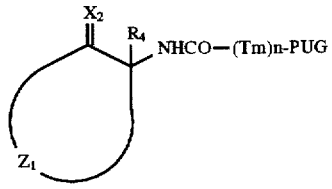

formula (9)

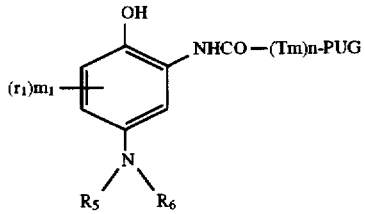

formula (10)

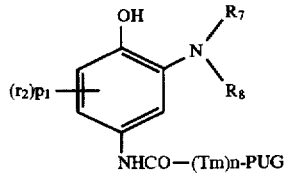

formula (11)

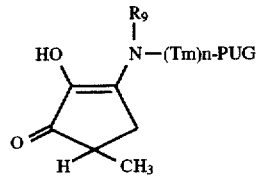

formula (12)

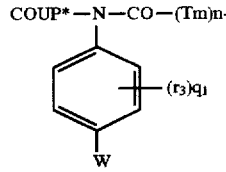

The compound having as a redox group —NHNH— is represented by the following formula (RE-a) or (RE-b):

formula (RE-a)

T—NHNHCO—(Tm)n-PUG formula (RE-b)

T—NHNHCOCO—(Tm)n-PUG

In formula (RE-a) or (RE-b), T represents an alkyl or aryl group which may have a substituent. The aryl group represented by T includes phenyl or naphthyl, which may have a substituent including a straight-chained or branched alkyl group (preferably an alkyl group having 2 to 20 carbon atoms, for example, methyl, ethyl, isopropyl or dodecyl), an alkoxy group (preferably an alkoxy group having 2 to 21 carbon atoms, for example, methoxy or ethoxy), an aliphatic acylamiono group (preferably an alkylamino group having 2 to 21 carbon atoms, for example, acetylamino or heptylamino) and an aromatic acylamiono group. T also includes a group in which substituted or unsubstituted aromatic groups combine with each other through a linkage group such as —CONH—, —O—, —$SO_2$NH—, —NHCONH— or —$CH_2$CHN—. Tm represents a timing group and n represents 0 or 1.

PUG represents 5-nitroindazole, 4-nitroindazole, 1-phenyltetrazole, 1-(3-sulfophenyl)tetrazole, 5-nitrobenzotriazole, 4-nitrobenzotriazole, 5-nitroimidazole or 4-nitroimidazole. These development inhibiting compounds bond with —CO— position of T—NHNHCO— through a hetero atom such as N or S or through alkylene, phenylene, aralkylene or aryl.

Besides the above compounds, a hydroquinone compound having a ballast group and a development inhibiting group such as triazole, indazole, imidazole, thiazole or thiadiazole can be used. The example includes 2-(dodecylethyleneoxidethiopropionamido)-5-(5-nitroindazole-2-yl)hydroquinone, 2-(stearylamido)-5-(1-phenyltetrazole-5-thio)hydroquinone, 2-(2,4-di-t-amylphenoxypropionamido)-5-(5-nitrotriazole-2-yl) hydroquinone and 2-dodecylthio-5-(2-mercaptothiothiadiazole-5-thio)hydroquinone.

The redox compound can be synthesized according to a method disclosed in U.S. Pat. No. 4,269,929. The redox compound may be contained in a silver halide emulsion layer or a hydrohylic colloid layer adjacent thereto or through an intermediate layer.

The redox compound is dissolved in alcohols such as methanol or ethanol, glycols such as ethylene glycol, triethylene glycol or propylene glycol, ethers, dimethylformamide, dimethylsulfoxide, tetrahydrofurane, an ester such as ethyl acetate, ketones such as acetone and methylethyl ketone to prepare a solution and is added as the solution. When the redox compound is sparingly soluble in a solvent, it is dispersed in the solvent through a high speed impeller, a sand mill, an ultrasonic wave or a ball mill to obtain particles having an average size of 0.01 to 6 μm. The dispersion may be carried out in the presence of a surfactant such as an anionic or nonionic surfactant, a thickner or latex. The redox compound content of the silver halide emulsion layer is $10^{-6}$ to $10^{-1}$ mol, and preferably $10^{-4}$ to $10^{-2}$ mol per mol of silver halide.

The especially preferable example of the compounds represented by formula (RE-a) or (RE-b) is listed below.

RE-1
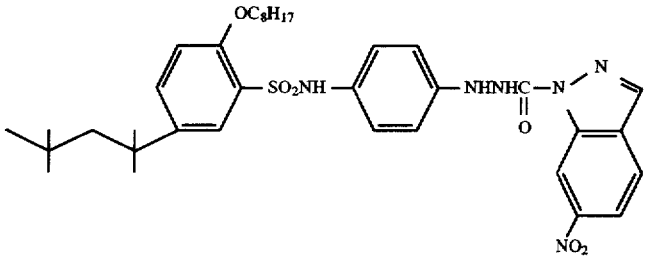
RE-2
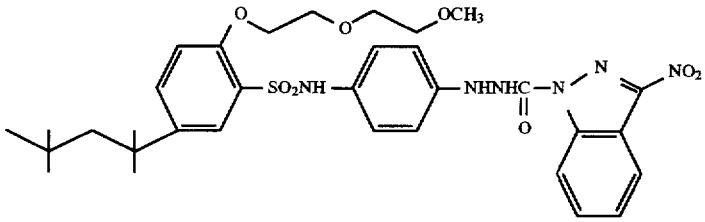
RE-3
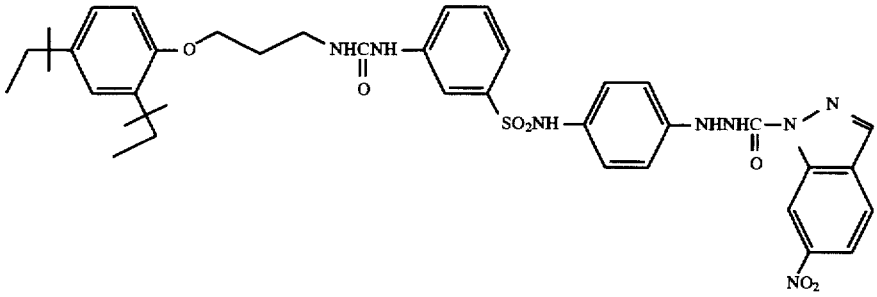
RE-4
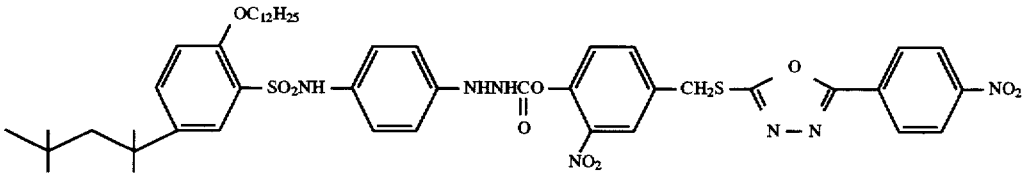
RE-5
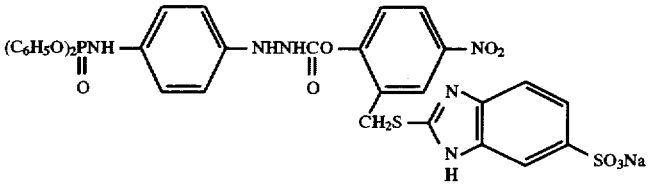
RE-6
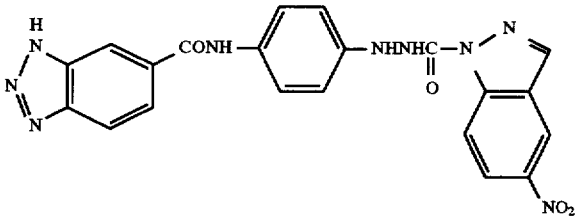

-continued

RE-7

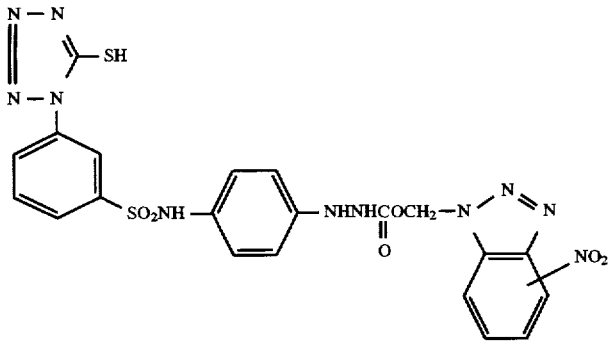

RE-8

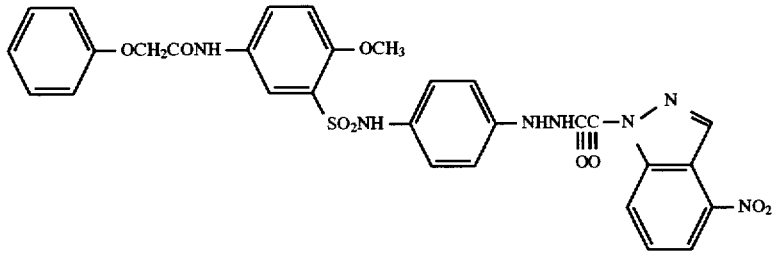

RE-9

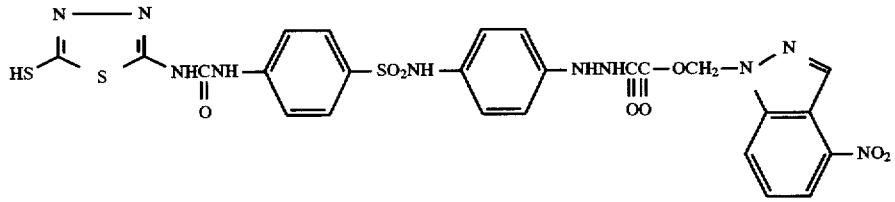

RE-10

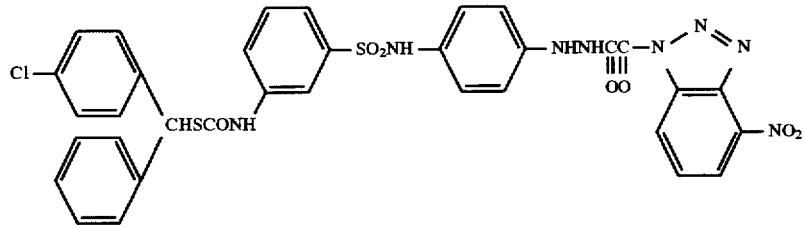

The other preferable redox compound includes exemplified compounds R-1 through R-50 disclosed in pages 236 to 250 of Japanese Patent O.P.I. Publication No. 4-24524/1992.

The redox compound represented by formula (7), (8), (9), (10), (11) or (12) will be explained below.

In formula (7), (8), (9), (10), (11) or (12), $R_1$ represents an alkyl group, an aryl group or a heterocyclic group; $R_2$ and $R_3$ independently represent a hydrogen atom, an acyl group, a carbamoyl group, a cyano group, a nitro group, a sulfonyl group, an aryl group, an oxalyl group, a heterocyclic group, an alkoxycarbonyl group or an aryloxycarbonyl group; $R_4$ represents a hydrogen atom; $R_5$ through $R_9$ independently represent a hydrogen atom, an alkyl group, an aryl group or a heterocyclic group; $r_1$, $r_2$ and $r_3$ independently represent a substituent present on the benzene ring; $X_1$ and $X_2$ independently represent O or NH; $Z_1$ represents an atomic group necessary to form a 5- or 6-membered heterocyclic ring; W represents OH or $N(R_{10})R_{11}$ in which $R_{10}$ and $R_{11}$ independently represent a hydrogen atom, an alkyl group, an aryl group or a heterocyclic group; COUP represents a coupler residue capable of coupling with an oxidation product of a primary aromatic amine developing agent; * represents a coupling position; Tm represents a timing group; $m_1$ and $p_1$ independently represent an integer of 0 to 3; $q_1$ represents an integer of 0 to 4; n represents an integer of 0 or 1; and PUG represents a development inhibiting group.

In formula (7), (8), (9), (10), (11) or (12), the alkyl, aryl or heterocyclic group represented by $R_1$, and $R_5$ through $R_{11}$ preferably includes methyl, p-methoxphenyl or pyridyl. Of an acyl group, a carbamoyl group, a cyano group, a nitro group, a sulfonyl group, an aryl group, an oxalyl group, a heterocyclic group, an alkoxycarbonyl group or an aryloxycarbonyl group represented by $R_2$ or $R_3$, the preferable is an acyl group, a carbamoyl group or a cyano group. These groups have preferably 1 to 20 carbon atoms. $R_1$ through $R_{11}$ may further have a substituent. The substituent includes a halogen atom (a chlorine or bromine atom), an alkyl group (for example, methyl, ethyl, isopropyl, hydroxyethyl, methoxymethyl, yrifluoromethyl, t-butyl), a cycloarkyl group (for example, cyclopentyl, cyclohexyl), an aralkyl group (for example, benzyl or 2-phenetyl), an aryl group (for example, phenyl, naphthyl, p-tolyl or 2-chlorophenyl), an alkoxy group (for example, methoxy, ethoxy, iso-propoxy or butoxy), an-aryloxy group (for example, phenoxy), cyano, an acylamino group (for example, acetylamino or propionyl amino), an alkylthio group (for example, methylthio, ethylthio or butylthio), an arylthio group (for example, phenylthio), a sulfonylamino group (for example, methanesulfonylamino, benzenesulfonylamino), a ureido group (for example, 3-methylureido, 3,3-dimethylureido or 1,3-dimethylureido), a sulfamoylamino group (for example, dimethylsulfamoylamino), a carbamoyl group (for example, methylcarbamoyl, ethylcarbamoyl or dimethylcarbamoyl), a sulfamoyl group (for example, ethylsulfamoyl or dimethylsulfamoyl), an alkoxycarbonyl group (for example, methoxycarbonyl, ethoxycarbonyl), an aryloxycarbonyl group (for example, phenoxycarbonyl), a sulfonyl group (for example, methanesulfonyl, butanesulfonyl or phenylsulfonyl), an acyl group (for example, acetyl, propanoyl or butyroyl), an amino group (for example, methylamino, ethylamino or dimethylamino), a hydroxy group, a nitro group, an imido group (for example, phthalimido), a heterocyclic ring group (for example, pyridyl, benzoimidazolyl, benzothiazolyl or benzoxazolyl). The coupler residue represented by COUP is as follows:

The cyan coupler residue includes a phenol or naphthol coupler residue, the magenta coupler residue includes a 5-pyrazolone, pyrazolone, cyanoacetylcumarone, open-chained acylacetonitrile or indazolone coupler residue, and the yellow coupler residue includes a benzoylacetoanilide, pivaloylacetoanilide or malondianilide coupler residue. The colorless coupler residue includes an open-chained or cyclic active methylene compound (for example, indanone, cyclopentanone, malonic acid diester, imidazolinone, oxazolinone or thiazolinone). The coupler residue represented by COUP preferably is a compound represented by the following formulas (Coup-1) through (Coup-8).

formula (Coup-1)

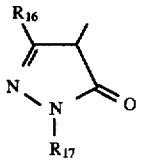

wherein $R_{16}$ represents acylamido, anilino, or ureido; and $R_{17}$ represents phenyl which may have a halogen atom, alkyl, alkoxy, or cyano; acylamido, anilino or ureido.

formula (Coup-2)

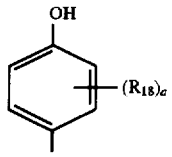

formula (Coup-3)

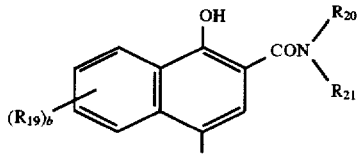

wherein $R_{18}$ and $R_{19}$ independently represent a halogen atom, acylamido, alkoxycarbonylamino, sulfoureido, alkoxy, alkylthio, hydroxy or an aliphatic group; $R_{20}$ and $R_{21}$ independently represent an aliphatic group, an aromatic group or a heterocyclic group, provided that one of $R_{20}$ and $R_{21}$ may be a hydrogen atom; a represents an integer of 1 to 4; b represents an integer of 0 to 5, provided that when a or b is 2 or more, $R_{18}$ or $R_{19}$ may be the same or different.

formula (Coup-4)

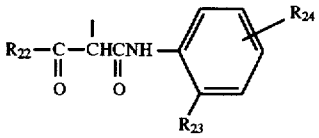

-continued formula (Coup-5)

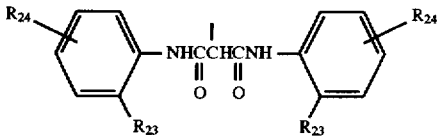

wherein $R_{22}$ represents a tertiary alkyl or aromatic group; $R_{23}$ represents hydrogen, halogen or alkoxy; and $R_{24}$ represents acylamido, an aliphatic group, alkoxycarbonyl, sulfamoyl, carbamoyl, a halogen atom or sulfonamido.

formula (Coup-6)

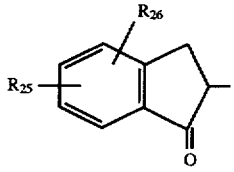

wherein $R_{25}$ represents an aliphatic group, alkoxy, acylamino, sulfonamido or diacylamino; and $R_{26}$ represents a hydrogen atom, a halogen atom or nitro.

formula (Coup-7)

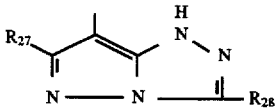

formula (Coup-8)

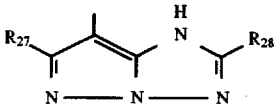

wherein $R_{27}$ and $R_{28}$ independently represent a hydrogen atom, an aliphatic group, an aromatic group or a heterocyclic group.

The 5- or 6-membered heterocyclic ring represented by $Z_1$ may be a single or condensed ring and is a 5- or 6-membered heterocyclic ring containing an O, S or N atom in the ring. The ring may have a substituent on the ring, and the substituent includes those as described above.

The timing group represented by Tm includes preferably —$OCH_2$— or another divalent timing group such as those disclosed in U.S. Pat. Nos. 4,248,962, 4,409,323 and 3,674,478, Research Disclosure 21228(December, 1981), and Japanese Patent O.P.I. Publication Nos. 57-56837/1982 and 4-438/1992.

The preferable development inhibiting group represented by PUG includes those disclosed in US Patent No. 4,477,563 and Japanese Patent O.P.I. Publication Nos. 60-218644/1985, 60-221750/1985, 60-236650/1985 and 61-11743/1986.

The example of the redox compound represented by formula (7), (8), (9), (10), (11) or (12) is listed below, but is not limited thereto.

Tm (* represents a position at which Tm is bonded with PUG)

Tm-1
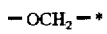
n = 1
Tm-2
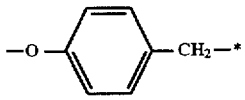
n = 1
Tm-3
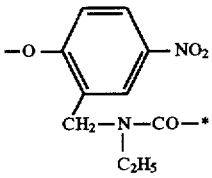
n = 1
Tm-4
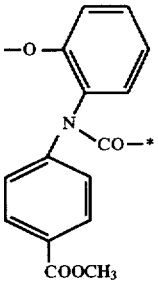
n = 1
Tm-5
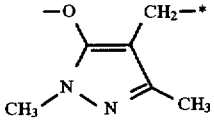
n = 1
Tm-6
n = 0
PUG 1
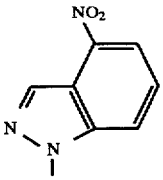
PUG 2
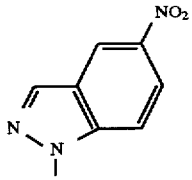
PUG 3
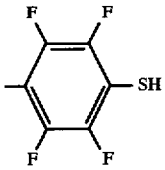
PUG 4
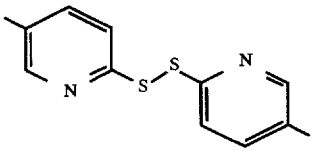
PUG 5
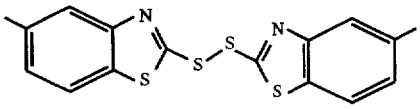
PUG 6
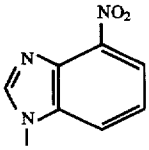
PUG 7
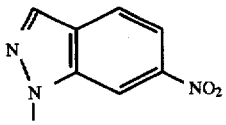
PUG 8
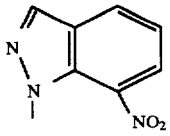
PUG 9
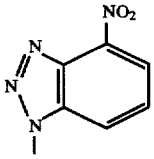
PUG 10
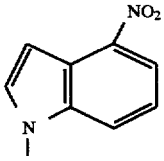
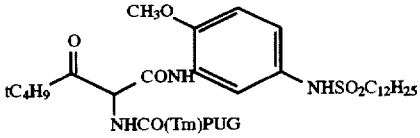

-continued
| Compound No. | PUG | Tm |
|---|---|---|
| 1 | 1 | 6 |
| 2 | 3 | 6 |
| 3 | 4 | 2 |
| 4 | 6 | 2 |
| 5 | 7 | 3 |
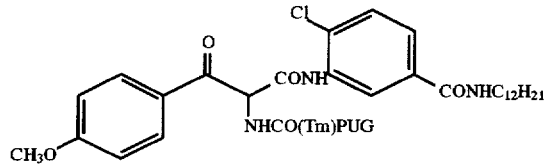
| Compound No. | PUG | Tm |
|---|---|---|
| 6 | 1 | 6 |
| 7 | 2 | 6 |
| 8 | 3 | 1 |
| 9 | 5 | 1 |
| 10 | 8 | 2 |
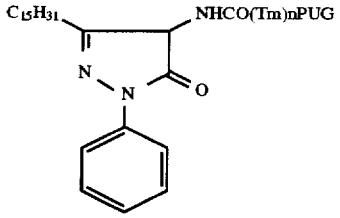
| Compound No. | PUG | Tm |
|---|---|---|
| 11 | 1 | 6 |
| 12 | 3 | 6 |
| 13 | 4 | 1 |
| 14 | 7 | 2 |
| 15 | 10 | 4 |
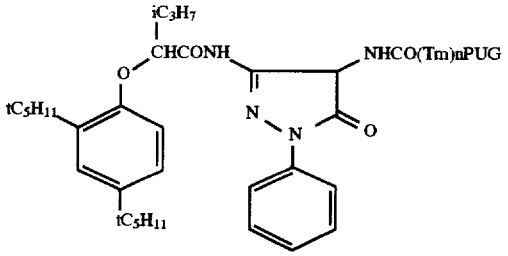
| Compound No. | PUG | Tm |
|---|---|---|
| 16 | 1 | 6 |
| 17 | 3 | 6 |
| 18 | 4 | 1 |
| 19 | 7 | 2 |
| 20 | 10 | 5 |
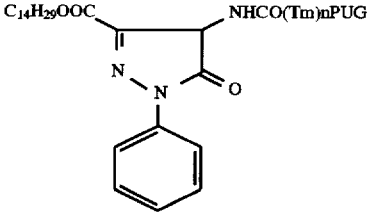
| Compound No. | PUG | Tm |
|---|---|---|
| 21 | 1 | 6 |

-continued
| | | |
|---|---|---|
| 22 | 3 | 6 |
| 23 | 4 | 2 |
| 24 | 7 | 2 |
| 25 | 9 | 3 |
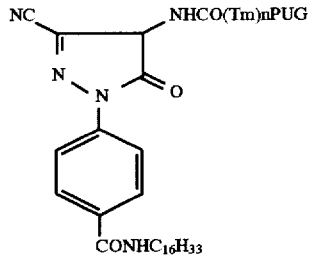
| Compound No. | PUG | Tm |
|---|---|---|
| 26 | 1 | 6 |
| 27 | 4 | 6 |
| 28 | 5 | 1 |
| 29 | 6 | 1 |
| 30 | 8 | 2 |
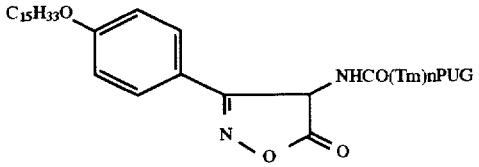
| Compound No. | PUG | Tm |
|---|---|---|
| 31 | 2 | 6 |
| 32 | 4 | 6 |
| 33 | 8 | 1 |
| 34 | 9 | 2 |
| 35 | 10 | 5 |
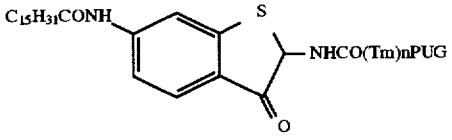
| Compound No. | PUG | Tm |
|---|---|---|
| 36 | 2 | 6 |
| 37 | 3 | 6 |
| 38 | 6 | 4 |
| 39 | 8 | 5 |
| 40 | 10 | 1 |
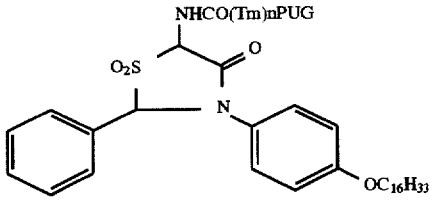
| Compound No. | PUG | Tm |
|---|---|---|
| 41 | 1 | 6 |
| 42 | 3 | 6 |
| 43 | 4 | 2 |
| 44 | 7 | 2 |
| 45 | 8 | 3 |

-continued
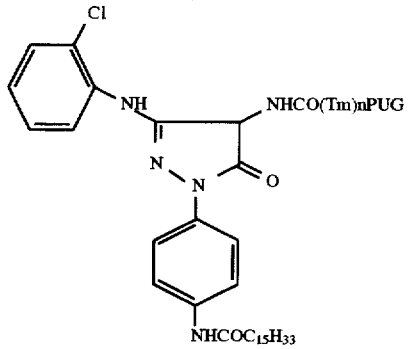
| Compound No. | PUG | Tm |
|---|---|---|
| 46 | 1 | 6 |
| 47 | 2 | 1 |
| 48 | 4 | 2 |
| 49 | 6 | 4 |
| 50 | 9 | 5 |
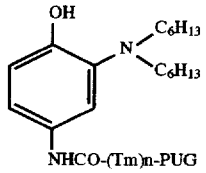
| Compound No. | PUG | Tm |
|---|---|---|
| 51 | 1 | 6 |
| 52 | 3 | 6 |
| 53 | 4 | 2 |
| 54 | 6 | 2 |
| 55 | 7 | 3 |
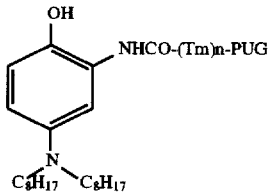
| Compound No. | PUG | Tm |
|---|---|---|
| 56 | 1 | 6 |
| 57 | 2 | 6 |
| 58 | 3 | 1 |
| 59 | 5 | 1 |
| 60 | 8 | 2 |
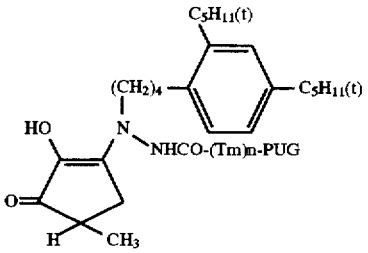
| Compound | PUG | Tm |
|---|---|---|
| 61 | 1 | 6 |
| 62 | 3 | 6 |
| 63 | 4 | 1 |

-continued
| | | |
|---|---|---|
| 64 | 7 | 2 |
| 65 | 10 | 4 |
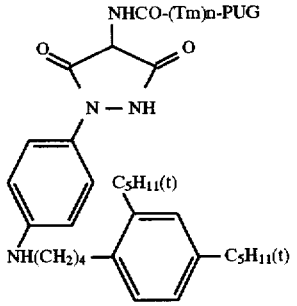
| Compound No. | PUG | Tm |
|---|---|---|
| 66 | 1 | 6 |
| 67 | 3 | 6 |
| 68 | 4 | 1 |
| 69 | 8 | 2 |
| 70 | 9 | 5 |
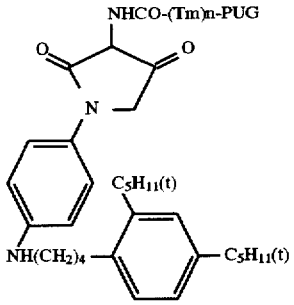
| Compound | PUG | Tm |
|---|---|---|
| 71 | 1 | 6 |
| 72 | 3 | 1 |
| 73 | 4 | 2 |
| 74 | 7 | 4 |
| 75 | 9 | 5 |
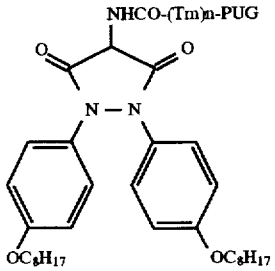
| Compound No. | PUG | Tm |
|---|---|---|
| 76 | 1 | 6 |
| 77 | 4 | 6 |
| 78 | 5 | 6 |
| 79 | 6 | 4 |
| 80 | 8 | 5 |

-continued
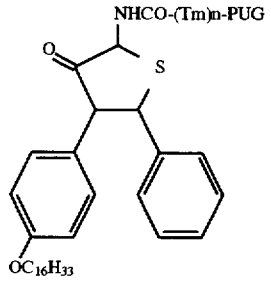
| Compound No. | PUG | Tm |
|---|---|---|
| 81 | 2 | 6 |
| 82 | 4 | 6 |
| 83 | 8 | 1 |
| 84 | 9 | 2 |
| 85 | 10 | 5 |
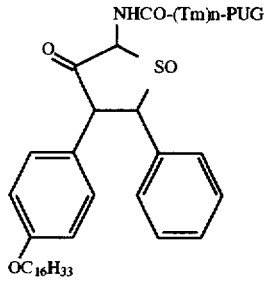
| Compound No. | PUG | Tm |
|---|---|---|
| 86 | 2 | 6 |
| 87 | 3 | 6 |
| 88 | 6 | 4 |
| 89 | 8 | 5 |
| 90 | 10 | 1 |
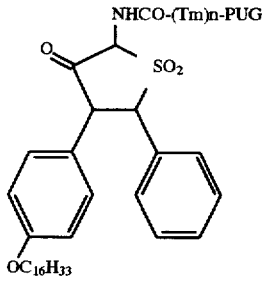
| Compound | PUG | Tm |
|---|---|---|
| 91 | 1 | 6 |
| 92 | 3 | 6 |
| 93 | 4 | 3 |
| 94 | 7 | 4 |
| 95 | 8 | 2 |

-continued
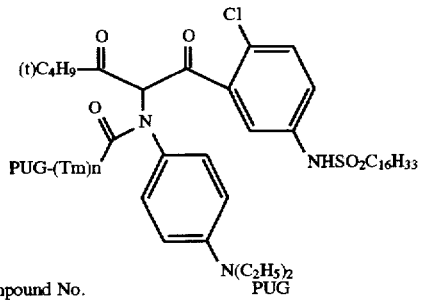
| Compound No. | PUG | Tm |
|---|---|---|
| 96 | 1 | 6 |
| 97 | 2 | 1 |
| 98 | 4 | 2 |
| 99 | 6 | 4 |
| 100 | 9 | 5 |
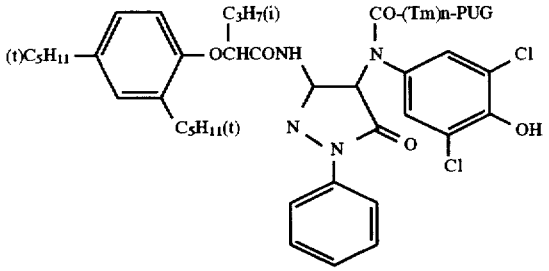
| Compound No. | PUG | Tm |
|---|---|---|
| 101 | 2 | 6 |
| 102 | 3 | 6 |
| 103 | 4 | 3 |
| 104 | 5 | 4 |
| 105 | 9 | 5 |
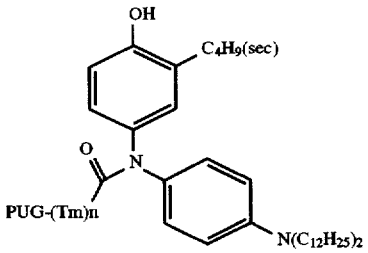
| Compound No. | PUG | Tm |
|---|---|---|
| 106 | 3 | 6 |
| 107 | 6 | 6 |
| 108 | 5 | 3 |
| 109 | 8 | 4 |
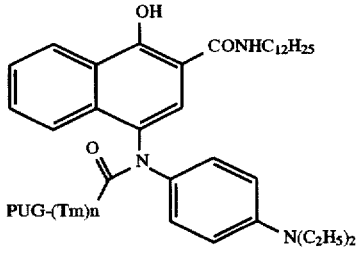
| Compound | PUG | Tm |
|---|---|---|
| 111 | 1 | 6 |
| 112 | 3 | 6 |

-continued

| | | |
|---|---|---|
| 113 | 4 | 1 |
| 114 | 8 | 1 |

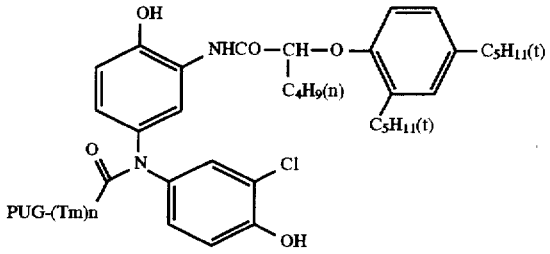

| Compound No. | PUG | Tm |
|---|---|---|
| 116 | 1 | 6 |
| 117 | 3 | 6 |
| 118 | 4 | 1 |
| 119 | 5 | 2 |
| 120 | 6 | 3 |

Redox Compound-121

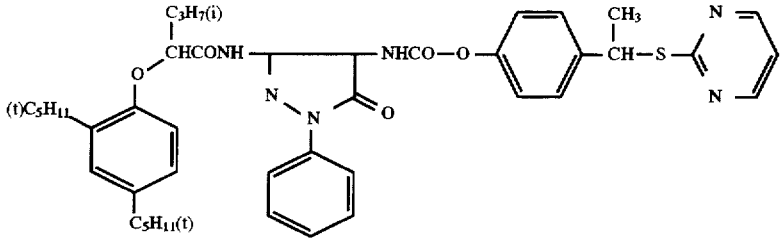

The content in the hydrophilic colloid layer of the compound represented by formula (7), (8), (9), (10), (11) or (12) is preferably $1\times10^{-6}$ to $5\times10^{-2}$ mol per mol of silver halide, and more preferably $1\times10^{-4}$ to $2\times10^{-2}$ mol per mol of silver halide.

The compound represented by formula (7), (8), (9), (10), (11) or (12) can be used as a solution which it is dissolved in a water miscible organic solvent such as alcohols, ketones, dimethylsulfoxide, dimethylformamide or methylcellosolve, as a conventional oil emulsified dispersion or as a solid dispersion in which it is dispersed in water by a ball mill, a colloid mill, an impeller disperser or an ultrasonic disperser.

The redox compound is contained in a silver halide emulsion layer, its adjacent layer or another layer other than the adjacent layer, preferably in a silver halide emulsion layer and/or its adjacent layer, and more preferably in a hydrophilic layer provided between a support and a silver halide emulsion layer closest to the support. The redox compound may be contained in plural different layers.

The silver halide emulsion may be sensitized by a sulfur, Se, Te, reduction or noble metal sensitization, or may not be chemically sensitized.

The sulfur sensitizer includes various sulfur compounds such thiosulfates, thiourea, rhodanines or polysulfides, in addition to a sulfur compound contained in gelatin. The selenium sensitizer is preferably triphenylselenophosphine.

The selenium sensitizer includes various selenium compounds. The example of the selenium sensitizer includes those disclosed in U.S. Pat. Nos. 1,574,944, 1,602,592 and 1,623,499 and Japanese Patent Publication Nos. 60-150046/1985, 4-25832/1990, 4-109240/1992, and 4-147250/1992. The useful selenium sensitizer includes colloidal selenium metal, isoselenocyanates (for example, allyl isoselenocyanate), selenoureas (for example, N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea), selenoketones (for example, selenoacetone, selenoacetophenone), selenoamides (for example, selenoacetoamide, N,N-dimethylselenobenzamide), selenocarboxylic acids or its esters (for example, 2-selenopropionic acid, methyl-3-selenobutylate), selenophosphates (for example, tri-p-triselenophosphate), selenides (for example, triphenylphosphineselenide, diethylselenide, diethyldiselenide,). The especially preferable selenium sensitizer is selenoureas, selenoamides, selenoketones or selenides.

The technique employing the selenium sensitizer is disclosed in U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, and France Patent Nos. 2,693,038 and 2,093,209 and Japanese Patent Publication Nos. 52-34491/1977, 52-34492/1977, 53-295/1978, 57-22090/1982, 59-180536/1984, 59-185330/1984, 59-181337/1984, 59-187338/1984, 59-292241/1984, 60-150046/1985, 60-151637/1985, 61-246738/1986, 3-4221/1991, 3-24537/1991, 3-111833/1991, 3-116132/1991, 3-148648/1991, 3-237450/1991, 4-16838/1992, 4-25832/1990, 4-4-32831/1990, 4-96059/1990, 109240/1992, 4-140738/1992, 4-140739/1992, 4-147250/1992, 4-149437/1992, 4-184331/1992, 4-190225/1992, 4-191729/1992, 4-140738/1992 and 4-195035/1992, British Patent Nos. 255,846 and 861,984 or in E. H. Spencer et al. Journal of Photographic Science, Vol. 31, 158–169 (1983).

The addition amount of the selenium sensitizer depends upon kinds of selenium sensitizer used, kinds of silver halide grains used or chemical ripening conditions, but is in the range of $1\times10^{-8}$ to $1\times10^{-4}$ mol per mol of silver halide.

When chemical sensitization is carried out employing the selenium sensitizer, temperature is preferably 40° to 90° C., and more preferably 45° to 80° C., the pH is preferably 4 to 9 and pAg is preferably 6 to 9. When the selenium sensitizer is water soluble, it can be added as it is, but when sparingly soluble in water, it may be added using the various methods, for example, using a mixture solution in which a sulfur sensitizer, a tellurium sensitizer and a selenium sensitizer are mixed in a gelatin solution obtained by solution or an emulsion solution obtained by dissolving a sensitizer in an organic solvent and dispersing it in a water in the presence of a surfactant in which the solvent is preferably removed after the dispersing. A method disclosed in Japanese Patent O.P.I. Publication No. 4-140739/1992 can be used which employs an emulsion solution obtained by dispersing the sensitizer in a solution containing a water-insoluble and organic solvent soluble polymer. The sensitizer is dispersed employing, for example, a high speed impeller disperser, a sand mill disperser, an ultrasonic disperser or a ball mill disperser.

The typical noble metal sensitization is gold sensitization. The complex of a noble metal other than gold, for example, platinum, palladium or rhodium can be used.

The reduction sensitizer includes stannous salts, amines, formamidines or silane compounds. In the invention, the oxidizing agent to silver can be used in a step of manufacturing a silver halide photographic light sensitive material. The oxidizing agent includes an inorganic oxidizing agent such as hydrogen peroxide, a hydrogen peroxide adduct, for example, $NaBO_2.H_2O_2.3H_2O$, $2Na_2CO_3.3H_2O_2$, $Na_4P_2O_7.2H_2O_2$, $2Na_2SO_4.H_2O_2.2H_2O$), a peroxy acid salt, for example, $K_2S_2O_8$, $K_2C_2O_6$, $K_4P_2O_8$, a peroxy complex, for example, $K_2[Ti(O_2)C_2O_4].3H_2O$, $4K_2SO_4.Ti(O_2).OH.SO_4.2H_2O$, $Na_2[VO(O_2)(C_2O_4)_2].6H_2O$, permanganates, for example, $KMnO_4$, chromates, for example, $K_2CrO_4$, halogen such as iodine or bromine, per halogenates, for example, potassium per iodate, a polyvalent metal salt, for example, potassium ferricyanate, and thiosulfonic acids. The organic oxidizing agent includes a quinone such as p-quinone, an organic peroxide such as per acetic acid or perbenzoic acid, and a compound capable of releasing an active halogen such as N-bromsuccinic imide, chloramine T or chloramine B. The especially preferable oxidizing agent is an inorganic oxidizing agent such ozone, hydrogen peroxide or its adduct or halogen, or an organic oxidizing agent such as a quinone or a compound capable of releasing an active halogen.

The addition amount of the oxidizing agent to silver is in the range of preferably $10^{-7}$ to $10^{-1}$ mol, more preferably $10^{-6}$ to $10^{-2}$ mol, and still more preferably $10^{-5}$ to $10^{-3}$ mol per mol of silver halide.

As a method adding the oxidizing agent to silver to a photographic emulsion at chemical sensitization, a conventional method is employed. When the oxidizing agent is water soluble, it can be added as an aqueous solution containing the oxidizing agent, and when the oxidizing agent is sparingly soluble or insoluble in water, it can be added as an organic solution in which the oxidizing agent is dissolved in water miscible organic solvents such as alcohols, glycols, ketones, eaters or amides, which have no adverse effect on photographic properties. The oxidizing agent can be also added in the solid dispersion form.

In the invention, the oxidizing agent to silver may be added in any step of manufacturing a silver halide light sensitive material, but is added preferably at the time from the silver halide grain formation to the coating of a silver halide emulsion layer.

In the invention, the silver halide of the silver halide emulsion is silver chloride, silver bromochloride having a silver chloride content of 60 mol % or more or silver bromoiodochloride having a silver chloride content of 60 mol % or more.

The average grain size of the silver halide grains is preferably not more than 0.7 μm, and more preferably not more than 0.3 to 0.1 μm. The grain size herein referred to is a grain diameter when grains are spherical or approximately spherical. When cubic, the size is a diameter in terms of spheres. A method of measuring the average grain size is detailed in T. H. James, "The Theory of the Photographic Process", the third edition, p. 36–43, (1966, issued by Mcmillan Co. Ltd.).

The silver halide grain shape is not specifically limited, and may be tabular, spherical, cubic, tetradecahedral, octahedral and the like. The grain size distribution is preferably narrow, and the silver halide emulsion is preferably a monodisperse emulsion in which 90% or more preferably 95% or more of the grains fall within the range of ±40% of the average grain size.

As a method of reacting a soluble silver ion with a soluble halide in the invention, a normal precipitation method, a double jet precipitation method or a combination thereof can be used.

A method of forming grains in the presence of an excess silver ion, so-called a reverse precipitation method can be used. As one method of the double jet precipitation, a method of maintaining pAg of the silver halide forming solution constant, so-called a controlled double jet method can be used. According to this method, silver halide grains of regular shape having an approximately uniform grain.

During silver grain formation or growth, complexes comprising an element appearing in III through XII of Periodic Table such as a salt of cadmium, zinc, lead, thallium, iridium, rhodium, ruthenium, osmium, iron, copper, platinum are preferably added to the silver halide emulsion. A ligand of the complexes includes a halogen atom, a nitrosyl group, a cyano group, an aqua group, an alkyl group, a pseudo-halogen group, an alkoxy group or an ammonium group or its combination. The halogen composition on the surface of silver halide grains can be controlled using a water soluble halogen compound or silver halide fine particles. Such a method is well known in the art as a conversion method. The silver halide grains may have grains having a uniform silver halide composition or grains composing of plural layers different in halide composition, kinds or content of doping agent or a lattice defect distribution. In the invention, plural kinds of silver halide grains can be used, which are different in grain size, sensitivity, crystal habit, spectral sensitivity, halogen composition, degree of grain size variation, kinds or content of doping agent, a manufacturing conditions such as potential, pH or a desalting method, surface property or chemical sensitization. These grains can be contained in the same silver halide emulsion layer or in plural different silver halide emulsion layers.

The silver halide emulsion and the preparing method thereof are detailed in Research and Disclosure (RD), 176, 17643, p. 22–23 (December, 1978) or in references cited in the same.

The silver halide emulsion can be spectrally sensitized by sensitizing dyes. The sensitizing dyes includes cyanine dyes, merocyanine dyes, complex cyanine dyes, complex merocyanine dyes, holopolar cyanine dyes, hemicyanine dyes, styryl dyes or hemioxonol dyes. The dyes may contain any nucleus ordinarily used in cyanine dyes as a basic heterocyclic ring. The ring includes a pyrroline, oxazoline, thiazoline, pyrrole, oxazole, thiazole, selenazole, imidazole, tetrazole or pyridine nucleus, or its ring condensed with an aliphatic or aromatic hydrocarbon ring including an indolenine, indol, benzoxazole, benzothiazole, naphthothiazole, benzoselenazole, benzimidazole or quinoline nucleus. These nucleus may have a substituent. The merocyanine dyes or complex merocyanine dyes include, as a nucleus containing keto-methylene, a 5- or 6-membered heterocyclic ring such as a pyrazoline-5-one, thiohydantoin, 2-thiooxazolidine-2,4-dione, thiazolidine-2,4-one or rhodanine, thiobarbituric acid nucleus. Typically, those disclosed in (RD) above, 176, 17643 (December, 1978), p. 23 and 24, (RD) 34686 (1993), U.S. Pat. Nos. 4,425,425 and 4,425,426 are employed. The dyes may be dissolved employing an ultrasonic vibration disclosed in U.S. Pat. No. 3,485,634. The method of dissolving or dispersing dyes in a solvent and adding to an emulsion includes those disclosed in U.S. Pat. Nos. 3,482,981, 3,585,195, 3,469,987, 3,425,835 and 3,342,605, British Patent Nos. 1,271,329, 1,038,029 and 1,121,174 and U.S. Pat. Nos. 3,660,101 and 3,658,546. These dyes may be used singly or in combination, and a combination thereof is often used for supersensitization. A dye combination or substances, which show supersensitization, are disclosed in (RD), 176, 17643 (December, 1978).

The silver halide photographic light sensitive material used in the invention may contain various compounds to prevent fog during the manufacture, storage or photographic processing or to stabilize photographic properties. The compounds include well known compounds as anti-foggants or stabilizing agents such as azoles (benzothiazoliums, nitroindazoles, nitrobenzimidazoles, chlorobenzimidazoles, bromobenzimidazoles, mercaptothiazoles, mercaptobenzothiazoles, mercaptothiadiazoles, aminotriazoles, benzotriazoles, nitrobenzotriazoles), mercaptotetrazoles (especially, 1-phenyl-5-mercaptotetrazoles), mercaptopyrimidines, mercaptotriazines (thioketo compounds such as oxazolinethiones), azaindenes (especially, 4-hydroxy-1,3,3a,7-tetraazaindenes), pentazaindenes, benzenethiosulfonic acid, benzenesulfinic acid or benzenesulfonamide. The especially preferable dye is a substituted or unsubstituted, heterocyclic or condensed heterocyclic compound comprising N, O, S or Se and its halide salt.

The silver halide emulsion layer or non-light sensitive layer used in the invention may contain another inorganic or organic hardener. The hardener includes chromium salts (chrome alum, chromium acetate), aldehydes (formaldehyde, glyoxal, glutaraldehyde), a N-methylol compound (dimethylolurea, methyloldimethylhydantoin), dioxane derivatives (2,3-dihydroxydioxane), active vinyl compounds (1,3,5-triacroyl-hexahydro-s-triazine, bis (vinylsulfonyl)-methylether, active halogen compounds (2,4-dichloro-6-hydroxy-s-triazine), mucohalogen acids (mucochloric acid, phenoxymucochloric acid), isooxazoles, starch dialdehyde, 2-chloro-6-hydroxytriazinylated gelatin, isocyanates and active carboxy hardeners. The hardeners may be used singly or in combination.

The silver halide emulsion layer or non-light sensitive layer used in the invention may contain a coating auxiliary or various conventional surfactants to prevent static, improve sliding property, help emulsify, prevent adhesion, and improve photographic properties.

Gelatin is advantageously used as a binder or protective colloid of the hydrophilic colloid layer in the invention, but another hydrophilic colloid can be used. The examples of the hydrophilic colloid include gelatin derivatives, grafted gelatins with another polymer, proteins such as albumin or casein, cellulose derivatives such as hydroxycellulose, carboxymethylcellulose or cellulose sulfate, saccharides such as sodium alginate or starch derivatives and synthetic hydrophilic polymers such as polyvinyl alcohol, polyvinyl alcohol partial acetal, poly-N-vinyl pyrrolidone, polyacrylic acid, polymethacrylic acid, polyacryl amide, polyvinyl imidazole or polyvinyl pyrazole.

Gelatin includes limed gelatin, acid processed gelatin, gelatin hydrolysate or enzyme decomposed gelatin.

The photographic emulsion in the invention may contain water insoluble or sparingly soluble synthetic polymer in order to improve dimensional stability. The synthetic polymer includes polymers obtained by polymerization of alkyl (meth)acrylate, alkoxyacryl(meth)acrylate, glycidyl (meth) acrylate, (meth)acryl amide, vinylester such as vinyl acetate, acrylonitrile, olefin, styrene or a combination thereof, or its combination with acrylic acid, methacrylic acid, $\alpha,\beta$-unsaturated dicarboxylic acid, hydroxyalkyl(meth)acrylate, sulfoalkyl(meth)acrylate or styrene sulfonic acid. The synthetic polymer may have a monomer unit having plural ethylenically unsaturated group. The monomer may have a water solubilizing group such as a hydroxy group, a sulfone group or an amido group, a primary to tertiary amino group, a phosphonium group, an aliphatic group, an aromatic group, $—N(R_1)N(R_2)(R_3)$ (in which $R_1$, $R_2$ and $R_3$ may be the same or different and independently represent a hydrogen atom, an aliphatic group, an aromatic group, a sulfinic acid group, an oxalyl group, a carbamoyl group, an amino group, a sulfonyl group, a sulfoxy group, an iminometylene group, an alkenyl group, alkinyl group, an aryl group, an alkoxy group, an alkenyloxy group, an alkinyloxy group or an aryloxy group) or a cation.

As a polymerizing method, a conventional method is used and polymerization may be carried out in the presence of a water soluble compound such as gelatin or polyvinyl alcohol. After the polymerization is completed, the polymer may be covered with gelatin or a silane coupling agent.

The light sensitive material may contain other additives such as a desensitizing agent, a plasticizer, a slipping agent, a development accelerator, oil or colloidal silica. The typical examples thereof are disclosed on pages 22–1 in Research Disclosure 176.

The silver halide emulsion layer may be single layered or multi-layered, and the multi-layered include an intermediate layer. The silver halide emulsion layer may comprise a non-light sensitive emulsion layer. The non-light sensitive emulsion layer may be optionally provided between a support and a silver halide emulsion layer closest to the support, between silver halide emulsion layers or outside a silver halide emulsion layer farthest from the support. The layers may contain a water soluble or insoluble dye, an imagewise or non-imagewise development adjusting agent (development inhibiting or accelerating agent), a contrast increasing agent, or a property adjusting agent, which is added in an aqueous or organic solvent solution thereof or in the form of solid particle dispersion which may or may not be protected with oil. The emulsion layer may be provided on one or both surfaces of a support. When the emulsion layer is provided on one surface of a support, a hydrophilic or non-hydrophilic layer may be provided on the surface opposite the emulsion layer of the support. When a hydrophobic polymer layer is provided outside the hydrophilic layer, a drying speed is high.

The silver halide emulsion layer or another layer is provided on one or both sides of a conventional flexible support. The flexible support includes a film made of a synthetic polymer such as cellulose acetate, cellulose acetate butyrate, polystyrene, polyethylene terephthalate or polyethylene naphthalate, or a paper support coated with a polymer such as polyethylene or polyethylene terephthalate. The support may have a magnetic recording layer, an antistatic layer or a peeling layer.

The developing agent used in the invention includes dihydroxybenzenes (for example, hydroquinone, chlorohydroquinone, bromohydroquinone, 2,3-dichlorohydroquinone, methylhydroquinone, isopropylhydroquinone or 2,5-dimethyhydroquinone), 3-pyrazolidones (for example, 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone) or aminophenols (for example, o-aminophenol, p-aminophenol, N-methyl-o-aminophenol, N-methyl-p-aminophenol, 2,4-diaminophenol), pyrogallol, ascorbic acid, 1-aryl-3-pyrazolines (for example, 1-p-methylaminophenyl-3-aminopyrazoline, 1-p-hydroxyphenyl-3-aminopyrazoline, 1-p-aminophenyl-3-aminopyrazoline, 1-p-amino-N-methylphenyl-3-aminopyrazoline, a transition metal complex (for example, a complex of a metal such as Ti, V, Cr, Fe, Co, Ni or Cu, which is in the form of a reducing compound in developer, for example, a complex of $Ti^{+3}$, $V^{+2}$, $Cr^{+2}$, $Fe^{+2}$ and a ligand, an aminocarboxylic acid or its salt such as ethylenediaminetetraacetic acid (EDTA) or diethylenetriaminepentaacetic acid (DTPA) or an phosphoric acid or its salt such as hexametapolyphosphoric acid or tetrapolyphosphoric acid). These can be used singly or in combination, but a combination of 3-pyrazolidones and dihydroxybenzenes, a combination of amonophenols and dihydroxybenzenes, a combination of 3-pyrazolidones and ascorbic acid, a combination of aminophenols and ascorbic acid, a combination of 3-pyrazolidones and transition metal complexes or a combination of aminophenols and transition metal complexes is preferable. The developing agents are preferably used in an amount of 0.01 to 1.4 mol/liter of developer.

In the invention an anti-sludging agent disclosed in Japanese Patent Publication No. 62-4702/198 and Japanese Patent O.P.I. Publication Nos. 3-51844/1991, 4-26838/1992, 4-362942/1992 and 1-319031/1889 can be used.

The developer waste can be regenerated by applying electric current. A waste developer tank in which a cathode (for example, a conductor or semiconductor such as stainless wool) is provided and an electrolyte tank in which an anode (for example, a conductor such as carbon, gold, platinum or titanium) is provided are arranged in such a manner that the waste developer is in contact with the electrolyte solution through an anion exchange membrane. The waste developer is regenerated by applying electric current to both electrodes. The light sensitive material can be processed while applying electric current. On generating developer, to the developer are added various additives such as preservatives, alkali agents, pH buffering agents, sensitizing agents, anti-foggants or anti-silver sludge agents. The light sensitive materials can be processed while applying current to the developer, to which the above additives can be further added. When developer waste is regenerated, the developer preferably contains a transition metal complex as a developing agent.

The sulfites or metabisulfites as preservatives include sodium sulfite, potassium sulfite, ammonium sulfite and sodium metabisulfite. The amount used of the sulfite is not less than 0.25 mol per liter, and preferably not less than 0.4 mol per liter of developer.

The developer preferably contains an alkali agent (sodium hydroxide or potassium hydroxide) and a pH buffering agent (for example, carbonates, phosphates, borates, boric acid, acetic acid, citric acid or alkanol amines). The pH buffering agent is preferably carbonates, and the pH buffering agent content is preferably 0.5 to 2.5 mol, more preferably 0.75 to 1.5 mol per liter of developer. The developer optionally contains auxiliary solubility agents (for example, polyethylene glycols or esters thereof or alkanol amines), sensitizing agents (for example, non-ionic surfactants including polyoxy ethylenes or quaternary ammonium salts), surfactants, anti-foggants (for example, halides such as potassium bromide and sodium bromide, nitro benzindazole, nitro benzimidazole, benzotriazoles, benzothiazoles, tetrazoles or thiazoles), chelating agents (for example, ethylenediaminetetraacetic acid or an alkali metal salt thereof, nitrilotriacetic acid salts or polyphosphoric acid salts), development accelerators (for example, compounds described in U.S. Pat. No. 2,394,025 and Japanese Patent Publication No. 47-45541/1972), hardeners (for example, glutaraldehyde or a bisulfite adduct thereof) or anti-foaming agents. The pH of the developer is preferably adjusted to be 8.5 to less than 12.5, and more preferably 9.0 to 10.9.

The developer used in the invention needs not contain dihydroxybenzenes, but preferably contains a compound represented by the following formula (1):

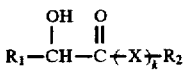

formula (1)

wherein $R_1$ and $R_2$ independently represent a hydrogen atom, a substituted or unsubstituted alkyl group, a substituted or unsubstituted amino group, a substituted or unsubstituted alkoxy group or a substituted or unsubstituted alkylthio group, provided that $R_1$ and $R_2$ may combine with each other to form a ring; and k represents 0 or 1, provided that when k is 1, X represents —CO— or —CS—, a sulfo group, a carboxy group, an amido group or a sulfonamido group; $Y_1$ represents O or S; $Y_2$ represents O, S or $NR_4$, in which $R_4$ is a substituted or unsubstituted alkyl group or a substituted or unsubstituted aryl group; and $M_1$ and $M_2$ independently represent an a hydrogen atom or an alkali metal atom.

Of the compound represented by formula (1), a compound represented by the following formula (1-a), in which $R_1$ and $R_2$ combine with each other to form a ring in a compound represented by formula (1), is preferred.

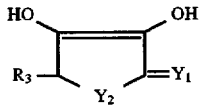

formula (1-a)

In formula (1-a), $R_3$ represents a hydrogen atom, a substituted or unsubstituted alkyl group, a substituted of unsubstituted aryl group, a substituted or unsubstituted amino group, a substituted or unsubstituted alkoxy group, a sulfo group, a carboxy group, an amido group or a sulfonamido group; $Y_1$ represents O or S; and $Y_2$ represents O, S or $NR_4$, in which $R_4$ is a substituted or unsubstituted alkyl group or a substituted or unsubstituted aryl group.

The alkyl group of formula (1) and formula (1-a) is preferably a lower alkyl group, such as an alkyl group having 1 to 5 carbon atoms; the amino group is preferably a unsubstituted amino group or an amino group having a lower alkyl group; the alkoxy group is preferably a lower alkoxy group; the aryl group is preferably a phenyl group or a naphthyl group; these groups may further have a substituent and the substituent is preferably a hydroxy group,a halogen atom, an alkoxy group, a sulfo group, a carboxy group, an amido group, or a sulfonamido group.

Examples of the compound represented by formulas (1) and (1-a) are shown below, but the present invention is not limited thereto.

Formula (1)

| Compound No. | $X_1$ | | $R_1$ | $R_2$ |
|---|---|---|---|---|
| A-1 | — | (k = 0) | $HOCH_2-CH(OH)-CH(OH)-$ | $-OH$ |
| A-2 | — | (k = 0) | $CH_3-CH(OH)-CH(OH)-$ | $-OH$ |
| A-3 | — | (k = 0) | $HOCH_2-CH(OH)-CH(OH)-$ | $-CH_3$ |
| A-4 | — | (k = 0) | $CH_3-CH(OH)-CH(OH)-$ | $-CH_3$ |
| A-5 | $-C(=O)-$ | (k = 1) | $HOCH_2-CH(OH)-CH(OH)-$ | $-OH$ |
| A-6 | $-C(=O)-$ | (k = 1) | $CH_3-CH(OH)-CH(OH)-$ | $-OH$ |
| A-7 | $-C(=S)-$ | (k = 1) | $HOCH_2-CH(OH)-CH(OH)-$ | $-OH$ |
| A-8 | $-C(=S)-$ | (k = 1) | $CH_3-CH(OH)-CH(OH)-$ | $-OH$ |
| A-9 | $-C(=O)-$ | (k = 1) | $HO-CH_2-$ | $-OH$ |
| A-10 | $-C(=O)-$ | (k = 1) | $HO-CH_2-$ | $-CH_3$ |
| A-11 | $-C(=O)-$ | (k = 1) | $HO-CH_2-$ | $-C_2H_5$ |
| A-12 | $-C(=O)-$ | (k = 1) | $HO-CH_2-$ | $-C_2H_4OH$ |

Formula (1-a)

| Compound No. | $Y_1$ | $Y_2$ | $R_3$ |
|---|---|---|---|
| A-13 | O | O | H |
| A-14 | O | O | $CH_3$ |
| A-15 | O | O | $CH_2(OH)$ |
| A-16 | O | O | $CH_3-CH(OH)-$ |
| A-17 | O | O | $HOCH_2-CH(OH)-$ |
| A-18 | O | O | $ClCH_2-CH(OH)-$ |

-continued

| | | | |
|---|---|---|---|
| A-19 | O | O | $HOOCCH_2-CH(OH)-$ |
| A-20 | S | O | H |
| A-21 | S | O | $CH_3-CH(OH)-$ |
| A-22 | S | O | $HOCH_2-CH(OH)-$ |
| A-23 | O | $NCH_3$ | H |
| A-24 | O | NH | $HOCH_2-CH(OH)-$ |
| A-25 | O | S | H |
| A-26 | O | S | $HOCH_2-CH(OH)-$ |
| A-27 | O | S | $CH_3-CH(OH)-$ |
| A-28 | S | S | H |
| A-29 | S | S | $HOCH_2-CH(OH)-$ |
| A-30 | S | S | H |

These compounds are typically ascorbic acid or erythorbic acid or derivatives thereof. They are available on the market and can be easily synthesized according to the well known synthesis method.

As developer used for processing a light sensitive material in the invention, a developer not substantially containing hydroquinones (for example, hydroquinone, chlorohydroquinone, bromohydroquinone, methylhydroquinone or hydroquinone monosulfonate). The developer not substantially containing hydroquinones herein referred to means a developer containing hydroquinones in an amount of less than 0.01 mol/liter.

In the invention a combination of a developing agent, a transition metal complex and a developing agent such as 3-pyrazolidones (for example, 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone) or aminophenols (for example, o-aminophenol, p-aminophenol, N-methyl-o-aminophenol, N-methyl-p-aminophenol, 2,4-diaminophenol) can be used. When the combination is used, 3-pyrazolidones or aminophenols are preferably used in an amount of 0.01 to 1.4 mol/liter of developer.

In the invention developer preferably contains a compound represented by formula (S) disclosed in pages 46 through 51 of Japanese Patent O.P.I. Publication No. 8-254796.

formula (S)

$$Z^1-S\,M^1$$

wherein $Z^1$ represents an alkyl group, an aromatic group or a heterocycle, each having a hydroxyl group, $-SO_3M$ or $-COOM$ in which M represents a hydrogen atom, an alkali metal atom or a substituted or unsubstituted ammonium, a substituted or unsubstituted amino group, a substituted or unsubstituted ammonio group or a substituent having at least one of them; and $M^1$ represents a hydrogen atom, an alkali metal atom or a substituted or unsubstituted amidino group (which may be in the form of a salt with hydrogen halide or sulfonic acid).

As a particular case in which the developing agent is contained in the light sensitive material, for example, in the emulsion layer or in its adjacent layer, the light sensitive material may be developed with an alkali solution, which is an activator processing solution. Such a light sensitive material may be also developed with developer. Such a development is often used as one of rapid processes in combination with silver stabilizing treatment of a thiocyanate, and the compounds of the invention can be applied thereto. The invention is markedly effected in such a rapid processing.

A fixer having a conventional composition can be used. The fixer is usually an aqueous solution comprised of a fixing agent and other additives, and has a pH of 3.8 to 5.8. As the fixing agent, thiosulfates such as sodium thiosulfate, potassium thiosulfate or ammonium thiosulfate, thiocyanates such as sodium thiocyanate, potassium thiocyanate or ammonium thiocyanate, or organic sulfur compounds capable of producing soluble stable silver complexes can be used.

To the fixer can be added water soluble aluminum salts acting as a hardener such as aluminum chloride, aluminium sulfate and potash alum. To the fixer can be optionally added preservatives such as sulfites or metabisulfites, pH buffering agents (for example, acetic acid), pH regulators (for example, sulfuric acid) or chelating agents capable of softening hard water. After fixing, washing is carried out. The washing bath may be replenished with fresh water in an amount of a few liters per minute according to processing. The circulated water, which is regenerated by the use of chemicals, filters or ozone or light, may be used for washing. Further, a stabilizing bath containing a stabilizer may be replenished with a small amount of stabilizer according to processing. This process is carried out usually at ordinary temperature, but may be carried out at 30° to 50° C. The stabilizing bath needs not connect a tube of tap water. Before and after each processing step, a rinsing bath may be provided. The mother developer, fixer or stabilizer or a developer, fixer or stabilizer replenisher is a working solution of developer, fixer or stabilizer or a solution in which a concentrated developer, fixer or stabilizer is diluted. The stock of the mother solution or replenisher may be in the form of a working solution, a concentrated solution, a paste, a viscous solution or a solid comprising a single component or a mixture of two or more components which is dissolved in use. The solid mixture is tableted or vacuum packed in layers in which inert component layers are adjacent to each other, and is dissolved in use. Particularly, a method of adding the tablets to a dissolving tank or directly to a processing tank is especially preferable in that storage stability of components is increased, processability is improved, and working space is reduced.

The developing temperature in the invention may be 20° to 50° C. In the invention a white and black light sensitive material is preferably processed using an automatic processor. The light sensitive material is processed while replenishing a developer or fixer replenisher in a specific amount in proportion to a processed area of light sensitive material. The replenishing amount of the replenisher is not more than 250 ml per $m^2$, preferably 75 to 200 ml of light sensitive material in order to reduce a waste solution. When the replenishing amount is less than 75 ml per $m^2$, satisfactory photographic properties can not be obtained, resulting in desensitization or contrast reduction.

In the invention, when using an automatic developing apparatus, the total processing time (Dry to Dry processing time) is preferably 10–60 seconds. The total processing time is the time taken from the entry of the leading edge of a film in the apparatus to the delivery of the tail end of the film out of the drying zone of the apparatus. The total processing time referred to herein is the total time necessary to process black-and-white silver halide photographic light-sensitive material, and concretely, the time necessary to carry out the steps, developing, fixing, bleaching, washing or stabilizing and drying, which is Dry to Dry time.

An automatic processor comprises a drying zone in which a warm air is used, but the drying zone comprises also heat conductors of 60° C. or more (for example, a heat roller of 60°–130° C. or more), heat radiation materials of 150° C. or more (for example, a material such as tungsten, carbon, nichrome, zirconium oxide-yttrium oxide-thorium mixture or silicon carbide emitting an infrared light by applying electric current or a heat heat conductor such as copper, stainless steel, nickel, or ceramics heated by transfer of heat from heat radiation materials), or the conventional drying means such as a dehumidifying apparatus, a microwave generating apparatus or a water absorbing resin. The dry controlling apparatus as disclosed in Japanese Patent O.P.I. Publication No. 1-315745/1889 may are provided.

EXAMPLES

The effect of the invention will be detailed in the following examples, but the invention is not limited thereto.

Example 1

(Preparation of Silver Halide Emulsion A1)

Silver bromochloride core grains comprised of 70 mol % of silver chloride and silver bromide, which had an average diameter of 0.09 μm, were prepared in a double-jet precipitation method. In the process $K_3Rh(NO)_4(H_2O)$ in an amount of $7\times10^{-8}$ mol/mol of silver and $K_3OsCl_6$ in an amount of $8\times10^{-6}$ mol/mol of silver were added and a silver nitrate solution and a water soluble halide solution were simultaneously added while keeping at pH 3.0, pAg 165 mV and 40° C. After reducing to pAg 125 mV with a sodium chloride solution, the shell was formed on the core in a double-jet precipitation method in which a halide solution containing $K_2IrCl_6$ in an amount of $3\times10^{-7}$ mol/mol of silver and $K_3RhCl_6$ in an amount of $9\times10^{-8}$ mol/mol of silver was used as a halide solution. KI conversion was further carried out using silver iodide fine particles. The resulting emulsion was proved to be an emulsion comprising cubic core/shell type monodisperse (a variation coefficient of 10%) silver bromoiodochloride grains (comprised of 70 mol % of silver chloride, 0.2 mol % of silver iodobromide and silver bromide) having an average diameter of 0.15 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$mol per mol of silver of 4-hydroxy-6-methyl-1,3,3a,7-tetrazaindene, $8.5\times10^{-4}$ mol per mol of silver of potassium bromide and citric acid, and adjusted to be pH 5.6 and EAg 123 mv. To the resulting emulsion were added $1\times10^{-3}$ mol/mol of silver of p-tosylchloramide sodium trihydrate (chloramine T) and inorganic sulfur compound (S8) in a solid dispersion (PM-1200 produced by Seishin Kigyou Co. Ltd. is dispersed in the presence of saponin to give an average size of 0.5 μm) and $1.5\times10^{-5}$ mol of chloroauric acid were added and chemically ripened at 55° C. to obtain maximum sensitivity. After the ripening, 100 mg of sensitizer d-1 and 5 mg of trihexylamine were added, cooled to 40° C., and then $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and $5\times10^{-3}$ mol per mol of silver of potassium iodide were added to the emulsion and adjusted to pH 5.1 with citric acid to obtain silver halide emulsion A.

(Preparation of Silver Halide Emulsion A2)

Silver halide emulsion A2 was prepared in the same manner as in silver halide emulsion A1, except that core grains were prepared at 50° C. instead of 50° C. and the shell was formed on the core using a halide solution containing $K_2IrCl_6$ in an amount of $3\times10^{-7}$ mol/mol of silver and $K_3RhCl_6$ in an amount of $6\times10^{-8}$ mol/mol of silver.

Silver halide emulsion A2 had 40% higher sensitivity than silver halide emulsion A1.

(Preparation of Silver Halide Photographic Light-Sensitive Material for Graphic Arts Containing a Hydrazine Derivative for a Scanner)

On a 100 μm thick polyethylene terephthalate film were simultaneously coated the following gelatin subbing layer composition, Prescription 1 in an amount of 0.45 g/m² of gelatin, the following silver halide emulsion 1 composition, Prescription 2 in an amount of 1.5 g/m² of silver and of 0.65 g/m² of gelatin, the following silver halide emulsion 2 composition, Prescription 3 in an amount of 1.5 g/m² of silver and of 0.65 g/m² of gelatin, and the following protective layer composition, Prescription 4 in an amount of 0.7 g/m² of gelatin, in that order. The following backing layer composition, Prescription 5 in an amount of 1.5 g/m² of gelatin and the following backing protective layer composition, Prescription 6 in an amount of 0.8 g/m² of gelatin in that order were simultaneously coated on a subbing layer, which was subjected to anti-static treatment as disclosed in Example 11 of Japanese Patent O.P.I. Publication No. 5-66512, of the polyethylene terephthalate film opposite the emulsion layer. After the emulsion layer side was coated through a curtain coating method at a coating speed of 200 m/minute and cooled, the backing layer side was simultaneously coated to set at −1° C. Thereafter, the both sides were simultaneously dried. Thus, light-sensitive material sample was prepared.

Layer 1
Prescription 1 (gelatin subbing layer composition)

| | |
|---|---|
| Gelatin | 0.45 g/m² |
| Saponin | 56.5 mg/m² |
| Polystyrene sodium sulfonate (Average molecular weight 500,000) | 15 mg/m² |
| Germicide g | 0.5 mg/m² |

Layer 2
Prescription 2 (silver halide emulsion layer 1 composition)

| | |
|---|---|
| Silver halide emulsion A1 | 1.5 g/m² (in terms of silver) |
| Sensitizing dye-1 | 150 mg/mol of AgI |

-continued

| | |
|---|---|
| Hydrazine compound: Exemplified Compound H-26 | $2\times10^{-3}$ mol/mol of AgI |
| Nuclear promoting compound Na-3 | 7 mg/m² |
| Compound a | 100 mg/m² |
| 2-Pyridinol | 1 mg/m² |
| Polymer latex L1 (particle diameter 0.25 μm) | 0.25 g/m² |
| Sodium iso-amyl-n-decylsuccinate | 0.7 mg/m² |
| Sodium naphthalene sulfonate | 8 mg/m² |
| Saponin | 20 mg/m² |
| Hydroquinone | 20 mg/m² |
| 2-Mercapto-6-hydroxypurine | 2 mg/m² |
| 2-Mercaptopyridine | 1 mg/m² |
| Colloidal silica (average diameter 0.05 μm) | 150 mg/m² |
| Ascobic acid | 20 mg/m² |
| EDTA | 25 mg/m² |
| Polystyrene sodium sulfonate (Average molecular weight 500,000) | 15 mg/m² |

The coating solution had a pH of 5.2.

Layer 3
Prescription 3 (silver halide emulsion layer 2 composition)

| | |
|---|---|
| Silver halide emulsion A2 | 1.5 g/m² (in terms of silver |
| Sensitizing Dye d-2 | 100 mg//mol of AgI |
| Hydrazine compound (Exemplified Compound H-27) | $4\times10^{-3}$ mol/mol of AgI |
| Nuclear promoting compound Na-3 | 7 mg/m² |
| Sodium iso-amyl-n-decylsuccinate | 1.7 mg/m² |
| 2-Mercapto-6-hydroxypurine | 1 mg/m² |
| Nicotinamide | 1 mg/m² |
| n-Propyl gallate | 50 mg/m² |
| Mercaptopyrimidine | 1 mg/m² |
| EDTA | 50 mg/m² |
| Styrene-maleic acid copolymer (Molecular weight 70,000) | 10 mg/m² |
| Polymer latex L2 (Japanese Patent O.P.I. Publication No. 5-66512) | 0.25 g/m² |
| Colloidal silica (average diameter 0.05 μm) | 150 mg/m² |

As gelatin, phthalated gelatin was used and the coating solution had a pH of 4.8.

Layer 4
Prescription 4 (emulsion protective layer composition)

| | |
|---|---|
| Gelatin | 0.6 g/m² |
| Amino compound AM-1 | 14 mg/m² |
| Sodium iso-amyl-n-decylsuccinate | 12 mg/m² |
| Matting agent (spherical polymethyl methacrylate of an average diameter 3.5 μm) | 25 mg/m² |
| Amorphous silica (Average diameter 8 μm) | 12.5 mg/m² |
| Surfactant S-1 | 26.5 mg/m² |
| Slipping agent (silicone oil) | 4 mg/m² |
| Compound a | 50 mg/m² |
| Polymer latex L4 (particle diameter 0.10 μm) | 0.25 g/m² |
| Colloidal silica (Average diameter 0.05 μm) | 150 mg/m² |
| Dye f1 | 20 mg/m² |
| 1,3-Vinylsulfonyl-2-propanol | 40 mg/m² |
| Polystyrene sodium sulfonate | 10 mg/m² |
| Germicide Z | 0.5 mg/m² |

Prescription 5 (backing layer composition)

| | |
|---|---|
| Gelatin | 0.6 g/m² |
| Sodium iso-amyl-n-decylsuccinate | 5 mg/m² |
| Polymer latex L4 | 0.3 g/m² |
| Colloidal silica (Average diameter 0.05 μm) | 100 mg/m² |
| Polystyrene sodium sulfonate | 10 mg/m² |
| Dye f1 | 65 mg/m² |
| Dye f2 | 15 mg/m² |
| Dye f3 | 100 mg/m² |
| 1-Phenyl-5-mercaptotetrazole | 10 mg/m² |
| Hardener h3 | 100 mg/m² |

-continued

| | |
|---|---|
| Zinc hydroxide | 50 mg/m² |
| EDTA | 50 mg/m² |
| Prescription 6 (protective backing layer composition) | |
| Gelatin | 0.4 g/m² |
| Matting agent (monodispersed polymethyl methacrylate of an average diameter of 5 μm) | 50 mg/m² |
| Amorphous silica (Average diameter 3 μm) | 12.5 mg/m² |
| Sodium-di-(2-ethylhexyl) sulfosuccinate | 10 mg/m² |
| Surfactant S1 | 1 mg/m² |
| Dye f1 | 65 mg/m² |
| Dye f2 | 15 mg/m² |
| Dye f3 | 100 mg/m² |
| Dye AD-13 in the invention (in solid) | 20 mg/m² |
| Compound a | 50 mg/m² |
| Hardener h2 | 20 mg/m² |
| Polystyrene sodium sulfonate | 10 mg/m² |

Dye AD-13 was dissolved in an alkaline solution and 1.2 times mole based on the acidic group in AD-13 of citric acid was added to obtain solid precipitates.

The following redox compound and solid dye were added to the layer as shown in Table 1. (Sensitivity of layer 2 proved to have sensitivity 40% lower than that of layer 3.)

| | |
|---|---|
| Redox compound-121 (solid fine particles obtained by dissolving it in ethyl acetate, dispersing the solution in a gelatin sollution and then vacuum evaporating the ethyl acetate) | 25 mg/m² |
| Dye AD-8 (in a solid dispersion) (solid dispersion having a particle diameter 0.1 μm obtained by dispersing it through ZrO beads) | 25 mg/m² |

Further, the hardener in the invention was added to the layer as shown in Table 1.

Thus, light sensitive material samples 1-1 through 1-16 were obtained.

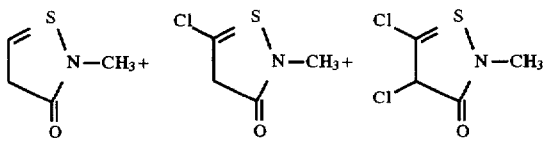

Germicide Z

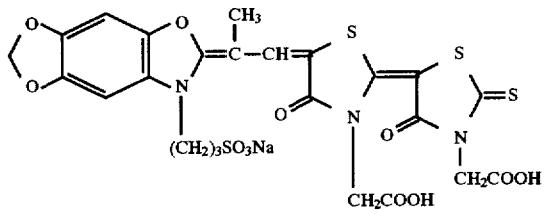

Sensitizing Dye d-1

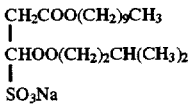

Compound a

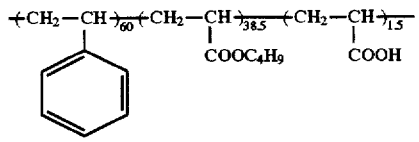

Polymer latex L1

HCHO

Hardner h1

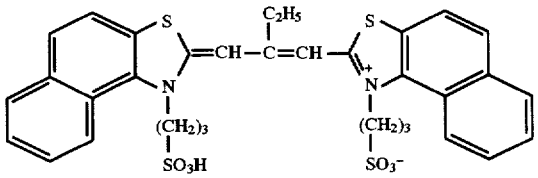

Sensitizing Dye d-2

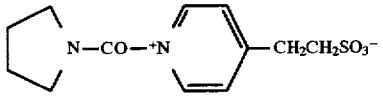

Hardener h2

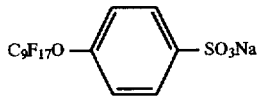

Surfactant S1

-continued

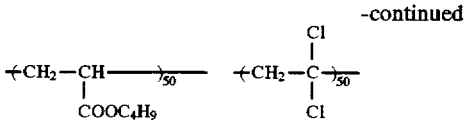

Polymer latex L4

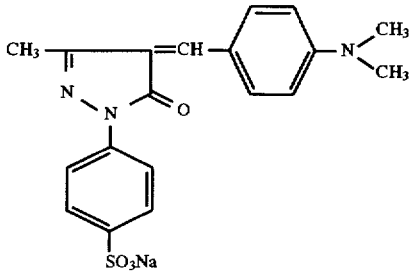

Dye f1

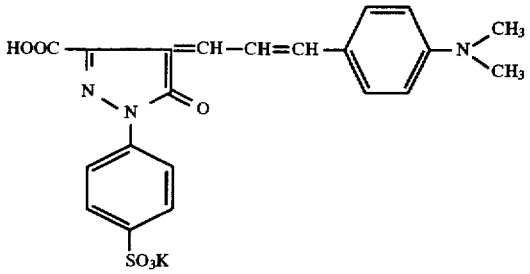

Dye f2

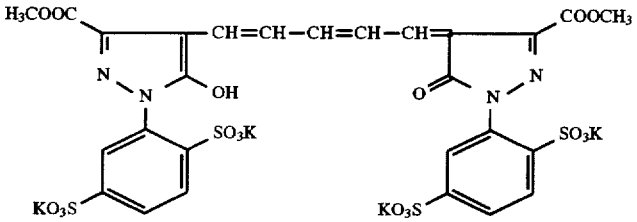

Dye f3

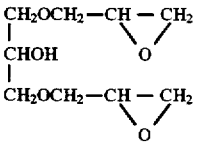

Haedener h3

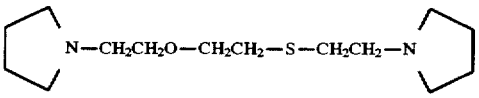

Amino compound AM-1

Developer composition (for working solution of 1 liter)

| | |
|---|---|
| Pentasodium diethyltriaminepentaacetate | 1 g |
| Sodium sulfite | 42.5 g |
| Potassium sulfite | 17.5 g |
| Potassium carbonate | 55 g |
| Hydroquinone | 20 g |
| 1-Phenyl-4-methyl-4-hydroxymethyl-3-pyrazolidone | 0.85 g |
| Potassium bromide | 4 g |
| 5-Methylbenzotrizole | 0.2 g |
| Boric acid | 8 g |
| Diethylene glycol | 40 g |
| 8-Mercaptoadenine | 0.3 g |

The working developer was adjusted to pH 10.4 using KOH.

| Fixer composition (for working fixer of 1 liter) | |
|---|---|
| Ammonium thiosulfate (70% ammonium thiosulfate solution) | 200 ml |
| Sodium sulfite | 22 g |
| Boric acid | 9.8 g |
| Sodium acetate trihydride | 34 g |
| Acetic acid (90% aq. solution) | 14.5 g |
| Tartaric acid | 3.0 g |
| Aluminum sulfate (27% aq. solution) | 25 ml |

The working fixer was adjusted to pH 4.9 using a sulfuric acid solution.

Processing condition:

| Step | Temperature | Time |
|---|---|---|
| Developing | 35° C. | 15 sec. |
| Fixing | 35° C. | 15 sec. |
| Washing | Ordinary temp. | 15 sec. |
| Squeezing and Drying | 50° C. | 15 sec. |
| | Total time | 60 sec. |

(Measurement of layer thickness and thickness swell percentage)

The silver halide emulsion layer side thickness of each of the light sensitive material samples was measured at 25° C. and 55%RH before swelling. Next, a drop of 25° C. distilled water was put on the emulsion layer side surface of each sample and allowed to stand for 3 minutes at 25° C. and 55%RH, after which the increased layer thickness increment was measured.

The thickness was measured through an electron micrometer K-306 produced by Anritu Denki Co., Ltd. The thickness swell percentage of each sample was obtained from the following formula:

(the increased layer thickness increment)×100/(the silver halide emulsion layer side thickness before swelling)

(Measurement of Sensitivity, γ)

The light sensitive material was stepwise exposed for $1.5\times10^{-7}$ seconds through a laser sensitometer employing a 633 nm He—Ne laser as a light source, varying an exposure amount. The resulting exposed sample was processed according to the above processing conditions using an automatic processor GR-27, a product by Konica Corp.

The exposed sample was processed with fresh developer or a running developer. The running developer herein referred to means a developer in which samples were developed until two times the volume of the developing tank of the automatic processor was replenished with developer replenisher having the same composition as the fresh developer in an amount of 200 ml/m$^2$. The replenishing amount of the fixer replenisher was 150 ml/m$^2$.

Sensitometry was carried out with a densitometer PDA-65, a Konica digital densitometer. Sensitivity was shown as a relative value, based on the sensitivity at a density of 2.5 of the light sensitive material sample No. 1-1 processed with the fresh solution being 100. Gamma is a gradation, defined as a tangent between densities of 0.1 and 3.0. The γ value of not less than 10 produces a super high contrast image.

(Evaluation of Storage Stability, Black Spots)

The light sensitive material sample prepared above was humidified at 23° C. and 60%RH for 24 hours, then tightly sealed in a air or moisture impermeable packing paper and stored at 55° C. for 24 hours. Thereafter, the resulting sample was processed in the same manner as above.

Black spots on the processed sample were visually checked through a 40 power magnifier. No appearance of black spots was evaluated as rank 5, and as the occurrence of black spots increases, the rank was evaluated as 4, 3, 2, 1 in the order. Ranks 2 and 1 are not of practical use.

(Evaluation of Scratch Resistance)

Pressure varying from 0 to 200 g was applied to an unexposed light sensitive material sample with a 0.2 mm diameter sapphire needle, employing a scratch meter HEIDON 18 Type produced by Shinto Kagaku Co., Ltd. The resulting sample was processed according to the above processing conditions using an automatic processor GR-27, a product by Konica Corp.

The blackening of the processed sample were visually checked. The blackening was evaluated with evaluation criteria, ranks 1 to 10. Ranks 4 or less is not of practical use.

The test conditions are shown in Table 1 and the test results are shown in Table 2.

TABLE 1

| No. | Dye added layer | Swelling rate (%) | Hardener Kinds | Hardener Added layer | Hardener Added amount (mg/m$^2$) | Hydrazine | DIR added layer | Remarks |
|---|---|---|---|---|---|---|---|---|
| 1-1 | — | 140 | h1 | 4 | 30 | *none | — | Comp. |
| 1-2 | — | 100 | h1 | 4 | 50 | none | — | Comp. |
| 1-3 | 1 | 140 | h1 | 4 | 30 | added | 1 | Comp. |
| 1-4 | — | 100 | A7 | 4 | 50 | none | 1 | Comp. |
| 1-5 | 1 | 80 | A7 | 4 | 70 | added | — | Inv. |
| 1-6 | 1,2 | 50 | A7 | 4 | 100 | added | 4 | Inv. |
| 1-7 | 1,2 | 50 | A7 | 4 | 100 | added | 4 | Inv. |
| 1-8 | 2 | 50 | A7 | 4 | 70 | added | 1 | Inv. |
| | | | B5 | 3 | 50 | | | |
| 1-9 | 2 | 140 | A7 | 4 | 30 | added | 4 | Comp. |
| 1-10 | 2 | 70 | B5 | 4 | 100 | added | 4 | Inv. |
| 1-11 | 1 | 70 | B5 | 4 | 100 | added | 2 | Inv. |
| 1-12 | 2 | 100 | C2 | 4 | 50 | added | 4 | Inv. |
| 1-13 | 2 | 60 | C2 | 4 | 80 | added | 4 | Inv. |
| 1-14 | 1,2 | 50 | C2 | 3 | 50 | added | 4 | Inv. |
| | | | A7 | 4 | 50 | | | |
| 1-15 | 1 | 90 | D1 | 4 | 100 | added | 4 | Inv. |
| 1-16 | 1,2 | 70 | D1 | 4 | 120 | added | 1 | Inv. |

DIR: Redox compound 121 25 mg/m$^2$

*"none" means that the hydrazine compounds were not added to Layers 2 and 3.

TABLE 2

| | Processing stability | | | | | Storage stability | |
|---|---|---|---|---|---|---|---|
| | Fresh solution | | Running solution | | Scratch | (Black spots) | |
| No. | Sensitibity | γ | Sensitibity | γ | resistance | Before storage | After storage |
| 1-1 | 100 | 6.5 | 95 | 6.0 | 4 | 4 | 4 |
| 1-2 | 100 | 6.2 | 98 | 6.0 | 5 | 4 | 4 |
| 1-3 | 145 | 16.8 | 100 | 10.5 | 5 | 5 | 2 |
| 1-4 | 90 | 6.2 | 82 | 5.7 | 4 | 4 | 4 |
| 1-5 | 135 | 16.5 | 132 | 15.3 | 8 | 5 | 4 |
| 1-6 | 135 | 16.3 | 132 | 15.3 | 9 | 5 | 5 |
| 1-7 | 133 | 16.2 | 131 | 15.8 | 10 | 5 | 5 |
| 1-8 | 135 | 16.5 | 132 | 15.4 | 10 | 5 | 5 |
| 1-9 | 135 | 16.5 | 110 | 12.0 | 5 | 5 | 2 |
| 1-10 | 130 | 15.5 | 125 | 14.5 | 8 | 5 | 4 |
| 1-11 | 130 | 15.3 | 125 | 14.3 | 8 | 5 | 4 |
| 1-12 | 130 | 16.0 | 125 | 15.5 | 9 | 5 | 4 |
| 1-13 | 130 | 16.0 | 125 | 15.5 | 10 | 5 | 4 |
| 1-14 | 130 | 16.0 | 125 | 15.5 | 10 | 5 | 5 |
| 1-15 | 130 | 15.4 | 122 | 14.5 | 8 | 5 | 4 |
| 1-16 | 130 | 15.4 | 124 | 14.3 | 9 | 5 | 4 |

As is apparent from Table 1, the inventive samples greatly improves scratch resistance. The sample containing the redox compound or the sample containing the dye dispersed in the solid form in the lowest layer more greatly improves scratch resistance.

Example 2

A light-sensitive material sample was prepared in the same manner as in Example 1, except that 3 mg/m$^2$ of each of sensitizing dyes d-3, d-4 and d-5 were added instead of sensitizing dyes d-1 and d-2. AD-15 was added instead of AD-8 and 50 mg/m$^2$ of dye f4 was further added to the backing layer.

The resulting material was processed in the same manner as in Example 1, except that the material was exposed using an infrared semiconductor laser having a wavelength of 780 nm, and evaluated in the same manner as in Example 1.

TABLE 3

| | Dye | Swell- | Hardener | | | | DIR | |
|---|---|---|---|---|---|---|---|---|
| No. | added layer | ing rate (%) | Kinds | Added layer | Added amount (mg/m$^2$) | Hydrazine | added layer | Remarks |
| 2-1 | — | 140 | h1 | 4 | 30 | *none | — | Comp. |
| 2-2 | — | 100 | h1 | 4 | 50 | none | — | Comp. |
| 2-3 | 1 | 140 | h1 | 4 | 30 | added | 1 | Comp. |
| 2-4 | — | 100 | A7 | 4 | 50 | none | 1 | Comp. |
| 2-5 | 1 | 80 | A7 | 4 | 70 | added | — | Inv. |
| 2-6 | 1,2 | 50 | A7 | 4 | 100 | added | 4 | Inv. |
| 2-7 | 1,2 | 50 | A7 | 4 | 100 | added | 4 | Inv. |
| 2-8 | 2 | 50 | A7 | 4 | 70 | added | 1 | Inv. |
| | | | B5 | 3 | 50 | | | |
| 2-9 | 2 | 140 | A7 | 4 | 30 | added | 4 | Comp. |
| 2-10 | 2 | 70 | B5 | 4 | 100 | added | 4 | Inv. |
| 2-11 | 1 | 70 | B5 | 4 | 100 | added | 2 | Inv. |
| 2-12 | 2 | 100 | C2 | 4 | 50 | added | 4 | Inv. |
| 2-13 | 2 | 60 | C2 | 4 | 80 | added | 3 | Inv. |
| 2-14 | 1,2 | 50 | C2 | 3 | 50 | added | 4 | Inv. |
| | | | A7 | 4 | 50 | | | |
| 2-15 | 1 | 90 | D1 | 4 | 100 | added | 4 | Inv. |
| 2-16 | 1,2 | 70 | D1 | 4 | 120 | added | 1 | Inv. |

DIR: Redox compound 121 25 mg/m$^2$
*"none" means that the hydrazine compounds were not added to Layers 2 and 3.

TABLE 4

| | Processing stability | | | | | Storage stability | |
|---|---|---|---|---|---|---|---|
| | Fresh solution | | Running solution | | | (Black spots) | |
| No. | Sensibility | γ | Sensibility | γ | Scratch resistance | Before storage | After storage |
| 2-1 | 100 | 6.4 | 93 | 6.0 | 4 | 4 | 4 |
| 2-2 | 100 | 6.2 | 95 | 5.8 | 5 | 4 | 4 |
| 2-3 | 145 | 15.8 | 100 | 10.0 | 5 | 5 | 2 |
| 2-4 | 90 | 6.0 | 80 | 5.5 | 4 | 4 | 4 |

TABLE 4-continued

| | | | | | | | |
|---|---|---|---|---|---|---|---|
| 2-5 | 135 | 15.8 | 132 | 15.2 | 8 | 5 | 4 |
| 2-6 | 135 | 15.7 | 133 | 15.2 | 9 | 5 | 5 |
| 2-7 | 134 | 15.6 | 134 | 15.5 | 10 | 5 | 5 |
| 2-8 | 136 | 15.6 | 135 | 15.5 | 10 | 5 | 5 |
| 2-9 | 135 | 15.6 | 100 | 11.0 | 5 | 5 | 2 |
| 2-10 | 130 | 15.3 | 125 | 15.0 | 8 | 5 | 4 |
| 2-11 | 130 | 15.3 | 127 | 14.7 | 8 | 5 | 5 |
| 2-12 | 130 | 15.5 | 120 | 14.6 | 9 | 5 | 4 |
| 2-13 | 130 | 15.5 | 126 | 14.2 | 10 | 5 | 4 |
| 2-14 | 130 | 15.5 | 128 | 15.3 | 10 | 5 | 5 |
| 2-15 | 130 | 15.2 | 124 | 14.1 | 8 | 5 | 4 |
| 2-16 | 130 | 15.2 | 124 | 14.5 | 9 | 5 | 5 |

Sensitizing d-3

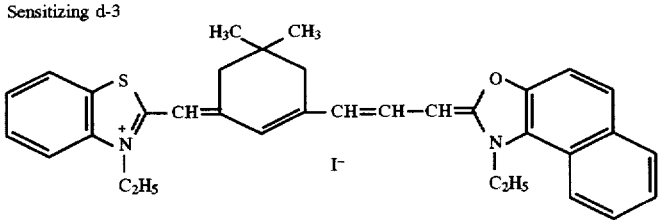

Sensitizing d-4

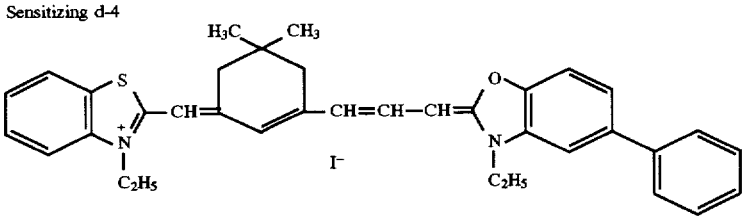

Sensitizing d-5

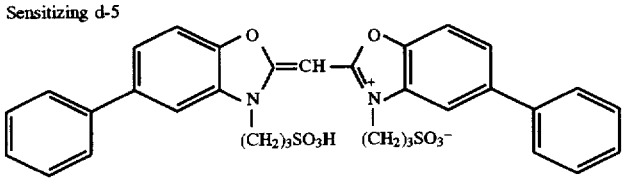

Dye f4

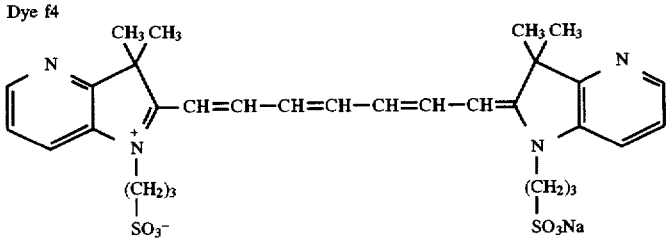

As is apparent from Tables 3 and 4, the same results as Example 1 were obtained.

Example 3

A light-sensitive material sample was prepared in the manner as in Example 1, except that 3 mg/m$^2$ of each of sensitizing dyes d-6 and d-7 were added instead of sensitizing d-1 and d-2, and AD-14 was added instead of AD-8.

The resulting material was processed in the same manner as in Example 1, except that the material was exposed using a 488 nm argon laser, and evaluated in the same manner as in Example 1.

TABLE 5

| | Dye | Swell- | Hardener | | | | DIR | |
|---|---|---|---|---|---|---|---|---|
| No. | added layer | ing rate (%) | Kinds | Added layer | Added amount (mg/m$^2$) | Hydrazine | added layer | Remarks |
| 3-1 | — | 140 | h1 | 4 | 30 | *none | — | Comp. |
| 3-2 | — | 100 | h1 | 4 | 50 | none | — | Comp. |

TABLE 5-continued

| No. | Dye added layer | Swelling rate (%) | Hardener Kinds | Hardener Added layer | Hardener Added amount (mg/m²) | Hydrazine | DIR added layer | Remarks |
|---|---|---|---|---|---|---|---|---|
| 3-3 | 1 | 140 | h1 | 4 | 30 | added | 1 | Comp. |
| 3-4 | — | 100 | A7 | 4 | 50 | none | 1 | Comp. |
| 3-5 | 1 | 80 | A7 | 4 | 70 | added | — | Inv. |
| 3-6 | 1,2 | 50 | A7 | 4 | 100 | added | 4 | Inv. |
| 3-7 | 1,2 | 50 | A7 | 4 | 100 | added | 4 | Inv. |
| 3-8 | 2 | 50 | A7 | 4 | 70 | added | 1 | Inv. |
| | | | B5 | 3 | 50 | | | |
| 3-9 | 2 | 140 | A7 | 4 | 30 | added | 4 | Comp. |
| 3-10 | 1,2 | 70 | B5 | 4 | 100 | added | 4 | Inv. |
| 3-11 | 1 | 70 | B5 | 4 | 100 | added | 2 | Inv. |
| 3-12 | 2 | 100 | C2 | 4 | 50 | added | 3 | Inv. |
| 3-13 | 1,2 | 60 | C2 | 4 | 80 | added | 4 | Inv. |
| 3-14 | 1,2 | 50 | C2 | 3 | 50 | added | 4 | Inv. |
| | | | A7 | 4 | 50 | | | |
| 3-15 | 1 | 90 | D1 | 4 | 100 | added | 4 | Inv. |
| 3-16 | 1,2 | 70 | D1 | 4 | 120 | added | 1 | Inv. |

DIR: Redox compound 121 25 mg/m²
*"none" means that the hydrazine compounds were not added to Layers 2 and 3.

TABLE 6

| No. | Processing stability: Fresh solution Sensitivity | Fresh solution γ | Running solution Sensitivity | Running solution γ | Scratch resistance | Storage stability (Black spots) Before storage | After storage |
|---|---|---|---|---|---|---|---|
| 3-1 | 100 | 6.5 | 95 | 6.0 | 4 | 4 | 4 |
| 3-2 | 100 | 6.2 | 98 | 6.0 | 5 | 4 | 4 |
| 3-3 | 145 | 16.5 | 100 | 10.3 | 5 | 5 | 2 |
| 3-4 | 90 | 6.1 | 82 | 5.6 | 4 | 4 | 3 |
| 3-5 | 133 | 16.3 | 130 | 15.1 | 8 | 5 | 4 |
| 3-6 | 131 | 16.3 | 130 | 15.1 | 8 | 5 | 5 |
| 3-7 | 131 | 16.3 | 130 | 15.3 | 9 | 5 | 5 |
| 3-8 | 135 | 16.3 | 133 | 15.7 | 10 | 5 | 5 |
| 3-9 | 133 | 16.1 | 105 | 12.0 | 5 | 5 | 2 |
| 3-10 | 128 | 15.4 | 123 | 14.4 | 8 | 5 | 4 |
| 3-11 | 128 | 15.2 | 123 | 14.4 | 8 | 5 | 5 |
| 3-12 | 128 | 15.9 | 123 | 15.3 | 9 | 5 | 4 |
| 3-13 | 125 | 15.9 | 123 | 15.3 | 10 | 5 | 4 |
| 3-14 | 125 | 15.9 | 123 | 15.6 | 10 | 5 | 5 |
| 3-15 | 128 | 15.3 | 122 | 14.4 | 8 | 5 | 4 |
| 3-16 | 125 | 15.3 | 120 | 14.4 | 9 | 5 | 4 |

Sensitizing d-6

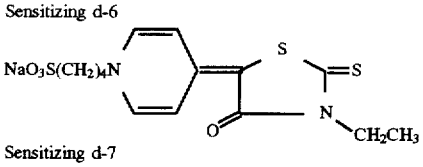

Sensitizing d-7

TABLE 6-continued

| No. | Processing stability: Fresh solution Sensitivity | Fresh solution γ | Running solution Sensitivity | Running solution γ | Scratch resistance | Storage stability (Black spots) Before storage | After storage |
|---|---|---|---|---|---|---|---|

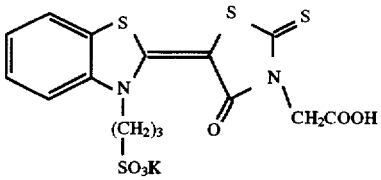

As is apparent from Tables 5 and 6, the same results as Example 1 were obtained.

Example 4

A light-sensitive material sample was prepared in the manner as in Example 1, except that 5 mg/m² of sensitizing dye d-8 were added instead of sensitizing dyes d-1 and d-2.

The resulting material was processed in the same manner as in Example 1, except that the material was exposed using a 670 nm red laser diode, and evaluated in the same manner as in Example 1.

TABLE 7

| No. | Dye added layer | Swelling rate (%) | Hardener Kinds | Hardener Added layer | Hardener Added amount (mg/m²) | Hydrazine | DIR added layer | Remarks |
|---|---|---|---|---|---|---|---|---|
| 4-1 | — | 140 | h1 | 4 | 30 | *none | — | Comp. |
| 4-2 | — | 100 | h1 | 4 | 50 | none | — | Comp. |
| 4-3 | 1 | 140 | h1 | 4 | 30 | added | 1 | Comp. |
| 4-4 | — | 100 | A7 | 4 | 50 | none | 1 | Comp. |
| 4-5 | 1 | 80 | A7 | 4 | 70 | added | — | Inv. |
| 4-6 | 1 | 50 | A7 | 4 | 100 | added | 4 | Inv. |
| 4-7 | 1,2 | 50 | A7 | 4 | 100 | added | 4 | Inv. |

TABLE 7-continued

| No. | Dye added layer | Swelling rate (%) | Hardener Kinds | Hardener Added layer | Hardener Added amount (mg/m²) | Hydrazine | DIR added layer | Remarks |
|---|---|---|---|---|---|---|---|---|
| 4-8 | 2 | 50 | A7 | 4 | 70 | added | 1 | Inv. |
| | | | B5 | 3 | 50 | | | |
| 4-9 | 2 | 140 | A7 | 4 | 30 | added | 4 | Comp. |
| 4-10 | 2 | 70 | B5 | 4 | 100 | added | 4 | Inv. |
| 4-11 | 1 | 70 | B5 | 4 | 100 | added | 2 | Inv. |
| 4-12 | 2 | 100 | C2 | 4 | 50 | added | 4 | Inv. |
| 4-13 | 2 | 60 | C2 | 4 | 80 | added | 4 | Inv. |
| 4-14 | 1,2 | 50 | C2 | 3 | 50 | added | 4 | Inv. |
| | | | A7 | 4 | 50 | | | |
| 4-15 | 1 | 90 | D1 | 4 | 100 | added | 4 | Inv. |
| 4-16 | 1,2 | 70 | D1 | 4 | 120 | added | 1 | Inv. |

DIR: Redox compound 121 25 mg/m²
*"none" means that the hydrazine compounds were not added to Layers 2 and 3.

TABLE 8

| No. | Processing stability: Fresh solution Sensitibity | Fresh solution γ | Running solution Sensitibity | Running solution γ | Scratch resistance | Storage stability (Black spots) Before storage | After storage |
|---|---|---|---|---|---|---|---|
| 4-1 | 100 | 6.5 | 95 | 6.0 | 4 | 4 | 4 |
| 4-2 | 100 | 6.2 | 98 | 6.0 | 5 | 4 | 4 |
| 4-3 | 145 | 16.7 | 100 | 10.5 | 5 | 5 | 2 |
| 4-4 | 90 | 6.2 | 82 | 5.7 | 4 | 4 | 4 |
| 4-5 | 135 | 16.4 | 132 | 15.3 | 8 | 5 | 4 |
| 4-6 | 135 | 16.3 | 132 | 15.3 | 9 | 5 | 5 |
| 4-7 | 133 | 16.3 | 131 | 15.7 | 10 | 5 | 5 |
| 4-8 | 135 | 16.4 | 132 | 15.5 | 10 | 5 | 5 |
| 4-9 | 135 | 16.4 | 105 | 11.5 | 5 | 5 | 2 |
| 4-10 | 130 | 15.5 | 125 | 14.5 | 8 | 5 | 4 |
| 4-11 | 130 | 15.3 | 125 | 14.3 | 8 | 5 | 5 |
| 4-12 | 130 | 16.0 | 125 | 15.5 | 9 | 5 | 4 |
| 4-13 | 130 | 16.0 | 125 | 15.5 | 10 | 5 | 4 |
| 4-14 | 130 | 16.0 | 125 | 15.5 | 10 | 5 | 5 |
| 4-15 | 130 | 15.4 | 122 | 14.5 | 8 | 5 | 4 |
| 4-16 | 130 | 15.4 | 124 | 14.3 | 9 | 5 | 4 |

Sensitizing d-8

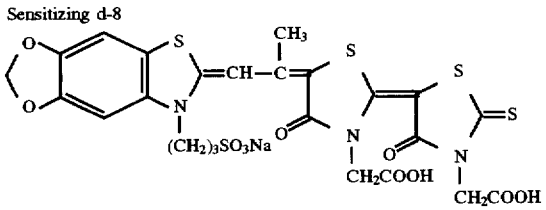

As is apparent from Tables 7 and 8, the same results as Example 1 were obtained.

Example 5

Silver halide emulsion A3 was prepared in the same manner as in silver halide emulsion A1 of Example 1, except that a solution containing $3\times10^{-8}$ mol of $K_3RhCl_6$ and $3\times10^{-7}$ mol of $K_2IrCl_6$ was used instead of a solution containing $9\times10^{-8}$ mol of $K_3RhCl_6$ and $3\times10^{-7}$ mol of $K_2IrCl_6$ in forming the shell. Silver halide emulsion A4 was prepared in the same manner as in silver halide emulsion A2 of Example 1, except that a solution containing $3\times10^{-8}$ mol of $K_3RhCl_6$ was used instead of a solution containing $6\times10^{-8}$ mol of $K_3RhCl_6$ in forming the shell. A light-sensitive material sample was prepared in the same manner as in Example 1, except that 5 mg/m² of each of sensitizing dyes d-5 and d-2 were added instead of sensitizing dyes d-1 and d-2 and silver halide emulsions A3 and A4 were used instead of silver halide emulsions A1 and A2.

The resulting material was processed in the same manner as in Example 1, except that the material was exposed using a 660 nm red LED light source, and evaluated in the same manner as in Example 1.

TABLE 9

| No. | Dye added layer | Swelling rate (%) | Hardener Kinds | Hardener Added layer | Hardener Added amount (mg/m²) | Hydrazine | DIR added layer | Remarks |
|---|---|---|---|---|---|---|---|---|
| 5-1 | — | 140 | h1 | 4 | 30 | *none | — | Comp. |
| 5-2 | — | 100 | h1 | 4 | 50 | none | — | Comp. |
| 5-3 | 1 | 140 | h1 | 4 | 30 | added | 1 | Comp. |
| 5-4 | — | 100 | A7 | 4 | 50 | none | 1 | Comp. |
| 5-5 | 1 | 80 | A7 | 4 | 70 | added | — | Inv. |
| 5-6 | 1,2 | 50 | A7 | 4 | 100 | added | 4 | Inv. |
| 5-7 | 1,2 | 50 | A7 | 4 | 100 | added | 4 | Inv. |
| 5-8 | 2 | 50 | A7 | 4 | 70 | added | 1 | Inv. |
| | | | B5 | 3 | 50 | | | |

TABLE 9-continued

| No. | Dye added layer | Swelling rate (%) | Hardener Kinds | Hardener Added layer | Hardener Added amount (mg/m²) | Hydrazine | DIR added layer | Remarks |
|---|---|---|---|---|---|---|---|---|
| 5-9 | 2 | 140 | A7 | 4 | 30 | added | 4 | Comp. |
| 5-10 | 2 | 70 | B5 | 4 | 100 | added | 4 | Inv. |
| 5-11 | 1 | 70 | B5 | 4 | 100 | added | 2 | Inv. |
| 5-12 | 2 | 100 | C2 | 4 | 50 | added | 4 | Inv. |
| 5-13 | 2 | 60 | C2 | 4 | 80 | added | 3 | Inv. |
| 5-14 | 1,2 | 50 | C2 | 3 | 50 | added | 4 | Inv. |
| | | | A7 | 4 | 50 | | | |
| 5-15 | 1 | 90 | D1 | 4 | 100 | added | 4 | Inv. |
| 5-16 | 1,2 | 70 | D1 | 4 | 120 | added | 1 | Inv. |

DIR: Redox compound 121 25 mg/m²
*"none" means that the hydrazine compounds were not added to Layers 2 and 3.

TABLE 10

| No. | Processing stability: Fresh solution Sensitibity | Fresh solution γ | Running solution Sensitibity | Running solution γ | Scratch resistance | Storage stability (Black spots) Before storage | After storage |
|---|---|---|---|---|---|---|---|
| 5-1 | 100 | 6.4 | 93 | 6.0 | 4 | 4 | 4 |
| 5-2 | 100 | 6.2 | 95 | 5.8 | 5 | 4 | 4 |
| 5-3 | 145 | 15.8 | 105 | 10.0 | 5 | 5 | 2 |
| 5-4 | 90 | 6.0 | 80 | 5.4 | 4 | 4 | 4 |
| 5-5 | 135 | 15.8 | 132 | 15.2 | 8 | 5 | 4 |
| 5-6 | 136 | 15.7 | 134 | 15.3 | 9 | 5 | 5 |
| 5-7 | 135 | 15.6 | 134 | 15.4 | 10 | 5 | 5 |
| 5-8 | 137 | 15.7 | 136 | 15.4 | 10 | 5 | 5 |
| 5-9 | 135 | 15.6 | 100 | 11.0 | 5 | 5 | 2 |
| 5-10 | 130 | 15.3 | 125 | 15.0 | 8 | 5 | 4 |
| 5-11 | 130 | 15.3 | 127 | 14.7 | 8 | 5 | 5 |
| 5-12 | 130 | 15.5 | 120 | 14.6 | 9 | 5 | 4 |
| 5-13 | 130 | 15.5 | 126 | 14.2 | 10 | 5 | 4 |
| 5-14 | 130 | 15.5 | 128 | 15.3 | 10 | 5 | 5 |
| 5-15 | 130 | 15.2 | 124 | 14.1 | 8 | 5 | 4 |
| 5-16 | 130 | 15.2 | 124 | 14.5 | 9 | 5 | 5 |

As is apparent from Tables 9 and 10, the same results as Example 1 were obtained.

Example 6

A light-sensitive material sample was prepared in the same manner as in Example 1, except that 5 mg/m² of sensitizing dye d-9 were added instead of sensitizing dyes d-1 and d-2 and AD-2 was used instead of AD-8.

The resulting material was processed in the same manner as in Example 1, except that the material was exposed through an optical wedge using an xenon lamp for 1 second, and evaluated in the same manner as in Example 1.

TABLE 11

| No. | Dye added layer | Swelling rate (%) | Hardener Kinds | Hardener Added layer | Hardener Added amount (mg/m²) | Hydrazine | DIR added layer | Remarks |
|---|---|---|---|---|---|---|---|---|
| 6-1 | — | 140 | h1 | 4 | 30 | *none | — | Comp. |
| 6-2 | — | 100 | h1 | 4 | 50 | none | — | Comp. |
| 6-3 | 1 | 140 | h1 | 4 | 30 | added | 1 | Comp. |
| 6-4 | — | 100 | A7 | 4 | 50 | none | 1 | Comp. |
| 6-5 | 1 | 80 | A7 | 4 | 70 | added | — | Inv. |
| 6-6 | 1,2 | 50 | A7 | 4 | 100 | added | 4 | Inv. |
| 6-7 | 1,2 | 50 | A7 | 4 | 100 | added | 4 | Inv. |
| 6-8 | 2 | 50 | A7 | 4 | 70 | added | 1 | Inv. |
| | | | B5 | 3 | 50 | | | |
| 6-9 | 2 | 140 | A7 | 4 | 30 | added | 4 | Comp. |
| 6-10 | 2 | 70 | B5 | 4 | 100 | added | 1 | Inv. |
| 6-11 | 1 | 70 | B5 | 4 | 100 | added | 2 | Inv. |
| 6-12 | 2 | 100 | C2 | 4 | 50 | added | 4 | Inv. |
| 6-13 | 2 | 60 | C2 | 4 | 80 | added | 3 | Inv. |
| 6-14 | 1,2 | 50 | C2 | 3 | 50 | added | 4 | Inv. |
| | | | A7 | 4 | | | | |
| 6-15 | 1 | 90 | D1 | 4 | 100 | added | 4 | Inv. |
| 6-16 | 1,2 | 70 | D1 | 4 | 120 | added | 1 | Inv. |

DIR: Redox compound 121 25 mg/m²
*"none" means that the hydrazine compounds were not added to Layers 2 and 3.

TABLE 12

| | Processing stability | | | | | Storage stability | |
|---|---|---|---|---|---|---|---|
| | Fresh solution | | Running solution | | Scratch | (Black spots) | |
| No. | Sensitibity | γ | Sensitibity | γ | resistance | Before storage | After storage |
| 6-1 | 100 | 6.5 | 95 | 6.0 | 4 | 4 | 4 |
| 6-2 | 100 | 6.2 | 98 | 6.0 | 5 | 4 | 4 |
| 6-3 | 145 | 16.8 | 100 | 10.5 | 5 | 5 | 2 |
| 6-4 | 90 | 6.2 | 82 | 5.7 | 4 | 4 | 4 |
| 6-5 | 135 | 16.5 | 132 | 15.3 | 8 | 5 | 4 |
| 6-6 | 135 | 16.2 | 131 | 15.2 | 9 | 5 | 5 |
| 6-7 | 132 | 16.2 | 130 | 15.7 | 10 | 5 | 5 |
| 6-8 | 135 | 16.5 | 132 | 15.4 | 10 | 5 | 5 |
| 6-9 | 135 | 16.3 | 110 | 11.5 | 5 | 5 | 2 |
| 6-10 | 127 | 15.3 | 123 | 14.5 | 8 | 5 | 4 |
| 6-11 | 127 | 15.1 | 123 | 14.3 | 8 | 5 | 4 |
| 6-12 | 127 | 15.8 | 123 | 15.4 | 9 | 5 | 4 |
| 6-13 | 127 | 15.8 | 123 | 15.4 | 10 | 5 | 4 |
| 6-14 | 127 | 15.8 | 123 | 15.4 | 10 | 5 | 5 |
| 6-15 | 127 | 15.2 | 120 | 14.5 | 8 | 5 | 4 |
| 6-16 | 127 | 15.2 | 121 | 14.2 | 9 | 5 | 4 |

Sensitizing d-9

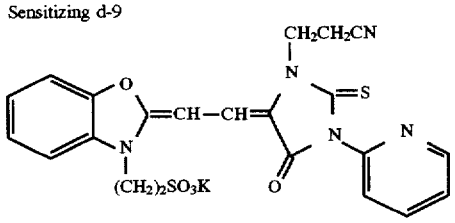

As is apparent from Tables 11 and 12, the same results as Example 1 were obtained.

Example 7

Silver halide emulsion A5 was prepared in the same manner as in silver halide emulsion A1 of Example 1, except that a solution containing $4\times10^{-5}$ mol of $K_3RhCl_6$ and $3\times10^{-7}$ mol of $K_2IrCl_6$ was used instead of a solution containing $9\times10^{-8}$ mol of $K_3RhCl_6$ and $3\times10^{-7}$ mol of $K_2IrCl_6$ in forming the shell, silver halide grains were formed to have a Cl/Br ratio of 98/2 and sensitizing dyes were not used. Silver halide emulsion A6 was prepared in the same manner as in silver halide emulsion A2 of Example 1, except that a solution containing $2\times10^{-5}$ mol of $K_3RhCl_6$ and $3\times10^{-7}$ mol of $K_2IrCl_6$ was used instead of a solution containing $9\times10^{-8}$ mol of $K_3RhCl_6$ and $3\times10^{-7}$ mol of $K_2IrCl_6$ in forming the shell and silver halide grains were formed to have a Cl/Br ratio of 98/2. A light-sensitive material sample was prepared in the same manner as in Example 1, except that sensitizing dyes d-1 and d-2 were not added, silver halide emulsions A5 and A6 were used instead of silver halide emulsions A1 and A2, 50 mg/m$^2$ of dyes f5 and f6 were added to the backing layer, 100 mg/m$^2$ of dye f1 were added, and 21 mg/m$^2$ of nuclear promoting compound Na-3 were added to layer 2.

The resulting material was processed in the same manner as in Example 1, except that the material was exposed in an exposure amount of 20 mJ/cm$^2$ using a super high pressure mercury lamp, and evaluated in the same manner as in Example 1.

TABLE 13

| | Dye | Swell- | Hardener | | | | DIR | |
|---|---|---|---|---|---|---|---|---|
| No. | added layer | ing rate (%) | Kinds | Added layer | Added amount (mg/m$^2$) | Hydrazine | added layer | Remarks |
| 7-1 | — | 140 | h1 | 4 | 30 | *none | — | Comp. |
| 7-2 | — | 100 | h1 | 4 | 50 | none | — | Comp. |
| 7-3 | 1 | 140 | h1 | 4 | 30 | added | 1 | Comp. |
| 7-4 | — | 100 | A7 | 4 | 50 | none | 1 | Comp. |
| 7-5 | 1 | 80 | A7 | 4 | 70 | added | — | Inv. |
| 7-6 | 1 | 50 | A7 | 4 | 100 | added | 4 | Inv. |
| 7-7 | 1,2 | 50 | A7 | 4 | 100 | added | 4 | Inv. |
| 7-8 | 2 | 50 | A7 | 4 | 70 | added | 1 | Inv. |
| | | | B5 | 3 | 50 | | | |
| 7-9 | 2 | 140 | A7 | 4 | 30 | added | 4 | Comp. |
| 7-10 | 2 | 70 | B5 | 4 | 100 | added | 4 | Inv. |
| 7-11 | 1 | 70 | B5 | 4 | 100 | added | 2 | Inv. |
| 7-12 | 2 | 100 | C2 | 4 | 50 | added | 3 | Inv. |
| 7-13 | 2 | 60 | C2 | 4 | 80 | added | 4 | Inv. |
| 7-14 | 1,2 | 50 | C2 | 3 | 50 | added | 4 | Inv. |
| | | | A7 | 4 | 50 | | | |
| 7-15 | 1 | 90 | D1 | 4 | 100 | added | 4 | Inv. |
| 7-16 | 1,2 | 70 | D1 | 4 | 120 | added | 1 | Inv. |

DIR: Redox compound 121 25 mg/m$^2$

*"none" means that the hydrazine compounds were not added to Layers 2 and 3.

TABLE 14

| | Processing stability | | | | | Storage stability | |
|---|---|---|---|---|---|---|---|
| | Fresh solution | | Running solution | | Scratch | (Black spots) | |
| No. | Sensitibity | γ | Sensitibity | γ | resistance | Before storage | After storage |
| 7-1 | 100 | 6.5 | 95 | 6.0 | 4 | 4 | 4 |
| 7-2 | 100 | 6.2 | 98 | 6.0 | 5 | 4 | 4 |
| 7-3 | 145 | 16.7 | 100 | 10.5 | 5 | 5 | 2 |
| 7-4 | 90 | 6.1 | 80 | 5.6 | 4 | 4 | 4 |
| 7-5 | 135 | 16.4 | 132 | 15.2 | 9 | 5 | 4 |
| 7-6 | 135 | 16.2 | 132 | 15.1 | 10 | 5 | 5 |
| 7-7 | 132 | 16.1 | 130 | 15.7 | 10 | 5 | 5 |
| 7-8 | 134 | 16.4 | 131 | 15.3 | 5 | 5 | 2 |
| 7-9 | 134 | 16.4 | 110 | 12.0 | 9 | 5 | 2 |
| 7-10 | 128 | 15.4 | 122 | 14.2 | 9 | 5 | 5 |
| 7-11 | 128 | 15.2 | 122 | 14.2 | 10 | 5 | 5 |
| 7-12 | 128 | 15.8 | 122 | 15.3 | 10 | 5 | 5 |
| 7-13 | 128 | 15.8 | 122 | 15.5 | 10 | 5 | 5 |
| 7-14 | 128 | 15.8 | 122 | 15.5 | 10 | 5 | 5 |
| 7-15 | 128 | 15.2 | 121 | 14.5 | 9 | 5 | 4 |
| 7-16 | 128 | 15.2 | 122 | 14.3 | 10 | 5 | 5 |

Dye f5

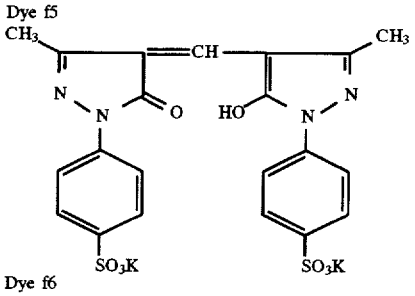

Dye f6

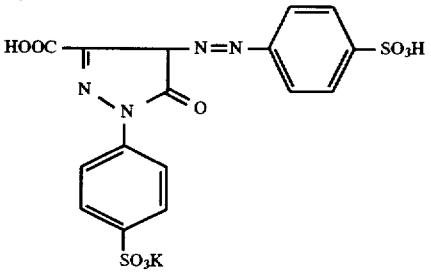

What is claimed is:

1. A silver halide photographic light sensitive material comprising a support and provided thereon, a hydrophilic colloid layer comprising at least one silver halide emulsion layer and at least one non-light sensitive layer, the hydrophilic colloid layer being hardened with at least one hardener selected from the group consisting of a carboxyl active hardener, a vinylsulfone type hardener, an epoxy type hardener and a triazine type hardener, wherein a silver halide emulsion layer closest to the support of the silver halide emulsion layers contains a dye in the form of dispersed solid particles or a non-light sensitive layer closest to the support of the non-light sensitive hydrophilic colloid layers contains a dye in the form of dispersed solid particles, and the thickness swell percentage of said hydrophilic colloid layer is 10 to 100%.

2. The material of claim 1, wherein the silver halide emulsion layer or its adjacent layer further contains a hydrazine compound.

3. The material of claim 1, wherein the hydrophilic colloid layer further contains a redox compound capable of releasing a development inhibitor in oxidation reaction.

4. The material of claim 1, wherein the silver halide emulsion layer closest to the support of the silver halide emulsion layers or a non-light sensitive layer adjacent to said silver halide emulsion layer closest to the support contains a redox compound capable of releasing a development inhibitor in oxidation reaction.

5. The material of claim 4, wherein a non-light sensitive layer provided between the silver halide emulsion layer closest to the support and the support contains a redox compound capable of releasing a development inhibitor in oxidation reaction.

6. The material of claim 1, wherein the material is developed with developer having a pH of from 9.0 to less than 11.0 to give an image having γ of 10 or more.

* * * * *